US005219717A

United States Patent [19]

Schmittou et al.

[11] Patent Number: 5,219,717

[45] Date of Patent: Jun. 15, 1993

[54] ARTICLE AND METHOD OF ITS USE FOR REMOVAL OF IODIDE ION FROM PHOTOGRAPHIC PROCESSING SOLUTION WITH A FIXING ABILITY

[75] Inventors: Eric R. Schmittou, Rochester; Glenn T. Pearce, Fairport; Michael R. Roberts, Rochester; Jacob J. Hastreiter, Jr., Spencerport, all of N.Y.

[73] Assignee: Eastman Kodak Company, Rochester, N.Y.

[21] Appl. No.: 815,788

[22] Filed: Jan. 2, 1992

[51] Int. Cl.[5] ..... G03C 5/395

[52] U.S. Cl. ..... 430/398; 430/400; 252/184; 428/304.4; 428/696

[58] Field of Search ..... 430/398, 400; 204/94; 252/184; 428/696, 304.4, 319.1, 318.4

[56] References Cited

U.S. PATENT DOCUMENTS

| | | | |
|---|---|---|---|
| 3,925,175 | 12/1975 | Fisch et al. | 430/484 |
| 4,207,157 | 6/1980 | Hirai et al. | 204/182.4 |
| 4,283,266 | 8/1981 | Hirai et al. | 204/263 |
| 4,313,808 | 2/1982 | Idemoto et al. | 204/182.4 |
| 4,361,493 | 11/1982 | Kiefer | 252/184 |

FOREIGN PATENT DOCUMENTS 2054182 2/1980 United Kingdom .

OTHER PUBLICATIONS

William D. Fairman, U.S. Atomic Energy Commission Report, Jun. 1964, pp. 1-23.

William D. Fairman & Jacob Sedlet, Analytical Chemistry, vol. 38, No. 9, Aug. 1966 pp. 1171-1175.

*Primary Examiner*—Charles L. Bowers, Jr.
*Assistant Examiner*—Mark F. Huff
*Attorney, Agent, or Firm*—Paul A. Leipold

[57] ABSTRACT

The invention is accomplished by providing an iodide ion absorbing method and article. The article is a composite article comprising a surfactant, an iodide absorbing medium, and a polymer that is permeable to iodide ion overlaying the iodide absorbing medium. In a preferred embodiment of the invention the polymer is an ionic polymer and the surfactant is an ionic surfactant with a charge opposite to that of the polymer. The surfactant can be incorporated in the absorbing medium, in the polymer, or it can overlay the polymer. In a preferred form of the invention, a substrate is coated with the iodide absorbing medium, a layer of an ionic polymer is overlaid on the absorbing medium, and a layer incorporating an ionic surfactant is overlaid onto the polymer. The ionic surfactant also may be placed in a layer between the polymer and the absorbing medium. A preferred absorbing medium is silver bromide. Preferred polymers are copolymers of methacrylate, methacrylamide, acrylate, or acrylamide monomers in which at least one monomer is cationic and the others are nonionic. Preferred surfactants are anionic surfactants, in particular, a mixture of sodium di- and tri-isopropylnaphthalenesulfonates sold commercially as Alkanol® XC, and a sodium sulfosuccinate diester sold commercially as Aerosol® OT.

60 Claims, 2 Drawing Sheets

ARTICLE AND METHOD OF ITS USE FOR REMOVAL OF IODIDE ION FROM PHOTOGRAPHIC PROCESSING SOLUTION WITH A FIXING ABILITY

TECHNICAL FIELD

The invention relates to the field of silver halide photographic recording materials and the processing of such materials. More specifically, it relates to the fixing of silver halide photographic recording materials using an aqueous solution containing thiosulfate as a fixing agent. In particular, it relates to processing methods in which the processing solution or solutions used to remove (fix) silver halide from the photographic recording material contain iodide. More particularly, the invention relates to a process for removing iodide ions from photographic processing solutions with a fixing ability that contain thiosulfate as a fixing agent. The invention relates to an ion exchange, ion absorbing, or ion adsorbing device for this removal of iodide.

BACKGROUND ART

The basic image-forming process of silver halide photography comprises the exposure of a silver halide photographic recording material to actinic radiation (for example, light or X-rays), and the manifestation of a usable image by the wet, chemical processing of the material. The fundamental steps of this processing entail, first, treatment of the recording material with one or more developing agents wherein some of the silver halide is reduced to metallic silver. With black-and-white photographic materials, the metallic silver usually comprises the desired image. With color photographic materials, the useful image consists of one or more images in organic dyes produced from an oxidized developing agent formed where silver halide is reduced to metallic silver.

To obtain useful black-and-white images it is usually desirable to remove the undeveloped silver halide, and to obtain useful color images it is usually desirable to remove all of the silver from the photographic element after the image has been formed. In black-and-white photography the removal of undeveloped silver halide is accomplished by dissolving it with a silver halide solvent, commonly referred to as a fixing agent, usually in an aqueous solution called a fixer bath. In color photography the removal of silver is generally accomplished by oxidizing the metallic silver, and dissolving the oxidized metallic silver and undeveloped silver halide with a fixing agent. The oxidation of metallic silver is achieved with an oxidizing agent, commonly referred to as a bleaching agent. The dissolution of oxidized silver and undeveloped silver halide can be accomplished concurrently with the bleaching operation in a bleach-fix process using an aqueous bleach-fix solution that contains both a bleaching agent and a fixing agent, or subsequent to the bleaching operation by using a separate fixer bath. For simplicity, hereinafter, we refer to both bleach-fix solutions and fixer baths as fixer baths.

It is highly desirable to process a photographic recording material as rapidly as feasible. In particular, keeping the silver removal steps, which consume a large amount of the total process time, as short as possible, is an attractive manner in which to shorten the overall processing time. Juxtaposed to the desire for a rapid process is the desire for, and the need for, photographic recording materials and processing solutions that require lower chemical usage and that generate less polluting chemical waste. One way to reduce chemical waste is to use lower replenishment or regeneration rates for the processing solutions, and reduce the volume of solution that overflows to the waste stream.

Unfortunately as fixer baths are used, reaction products accumulate in the solutions. These products, mainly dissolved silver and halide ions, retard the fixing reaction and impair the performance of the fixer bath. Iodide ions, if present, have a very strong retarding effect on the fixing process. The concentrations of silver and halide ions can become even higher, and their retarding effect on fixing become even more severe, as replenishment or regeneration rates for the processing solutions are decreased in an attempt to reuse or recycle more of the processing solution and thereby to decrease waste processing effluent.

Some degree of fixing improvement and waste reduction can be achieved by removing silver from used, or so-called seasoned, fixer baths by chemical and electrochemical means. But these treatments do not remove the detrimental halide ions, in particular, the especially harmful iodide ion if present, from the fixing solution, and so fixing performance cannot be completely restored and eventually the fixer solution must be discarded or replenished with more fresh solution.

Therefore, if iodide ion could be removed, it would result in a more rapid photographic process, and it would extend the life of the fixer bath, while enabling low replenishment rates to be used.

The removal of iodide ion from a fixer bath is made difficult by the presence of other solution components, such as thiosulfate, sulfite, and argentothiosulfate complex ions. It is desired not to remove the sulfite ions and the thiosulfate ion, which is the active fixing agent. Silver can be removed separately by means of several known methods. Unfortunately, many methods which might remove iodide ion such as oxidation, precipitation, complexation and ion exchange will be interfered with by these other anions. Sulfite and thiosulfate are easily oxidized. Many substances which precipitate or complex with iodide also react with thiosulfate. Anion exchange media will extract sulfite and thiosulfate, as well as iodide. Further, the problem of removing iodide is made more difficult by the high concentration of the potentially interfering components. The thiosulfate concentration is usually in the range of 0.1 to 2.0 molar. The sulfite-hydrogen sulfite concentration is 0.01 to 0.5 molar. Iodide concentration may be as high as 0.05 molar, but it is often desired to maintain it less than about 0.005 molar. Therefore, it is desired that the system intended for iodide removal should exhibit a selectivity for iodide over thiosulfate and sulfite.

U.S. Pat. No. 3,925,175—Fisch et al discloses removal of silver and halide by passing the fixing solution through a cathode chamber of an electrolysis cell. The electrolysis cell has an anionic semipermeable membrane separating the anode and cathode and further contains a solution of electro-active oxidizable species in the anode chamber. However, such semipermeable membranes are expensive and are often fouled or plugged by solution components making them ineffective for separating after a short time. Further, the process requires electrical equipment and power, increasing the cost and complexity of separation.

U.S. Pat. No. 4,313,808—Idemoto et al, U.S. Pat. No. 4,283,266—Hirai et al, and U.S. Pat. No. 4,207,157—Hirai et al disclose electrodialysis systems utilized with photographic developers. However, these systems too are prone to membrane fouling and require expensive electrical equipment.

European Patent Application 0 348 532—Ueda et al discloses contacting the fixing solution with an ion exchange resin to accelerate the fixing of a silver iodide containing photographic material and reduce the amount of waste fixing solution. However, such resins remove ions other than iodide ion, such as thiosulfate, sulfite, and complexed silver ion, as described above. This method is not necessarily successful in removing iodide from solutions which contain many other anionic components.

U.S. Pat. No. 4,948,711—Kojima et al discloses bleach-fixing and fixing solutions, containing dispersions (latexes) of cationic polymers or water soluble cationic polymers, that exhibit more rapid desilvering. However, such polymers and dispersions may not be safe for the environment and may contaminate waste effluent from the process. They may also contaminate processed photographic materials.

Therefore, there remains a need for an effective, easy to use system for removal of iodide ions from fixer baths, without expensive equipment, or contaminating chemicals.

DISCLOSURE OF INVENTION

An object of the invention is to overcome disadvantages of prior methods of removal of iodide ion from fixer baths.

Another object is to improve fixing performance without increasing chemical replenishment.

Another object is to minimize the amount of replenishment required for fixer baths.

An additional object is to minimize the effluent discharge from photographic processes.

These and other objects of the invention are generally accomplished by providing an iodide absorbing method and article. The article is a composite article comprising a surfactant, an iodide absorbing medium, and a polymer that is permeable to iodide ion overlaying the iodide absorbing medium. By "iodide absorbing medium" we mean any material or combination of materials that can absorb, adsorb, oxidize, or exchange iodide ions, that is not itself able to permeate the overlying polymer, and that prevents the iodide ion or the reaction products from iodide ion from re-entering the fixer solution. In a preferred embodiment of the invention the polymer is an ionic polymer and the surfactant is an ionic surfactant with a charge opposite to that of the polymer. The surfactant can be incorporated in the absorbing medium, in the polymer, or it can overlay the polymer. The polymer in the resulting article is permeable to the small ions in the fixer bath (iodide and bromide ions), but impermeable to the larger ions in the fixer bath (thiosulfate and sulfite ions). The underlying iodide absorbing medium is then able more selectively to remove the iodide ions from the fixer bath. In a preferred form of the invention, a substrate is coated with the iodide absorbing medium, a layer of ionic polymer is overlaid on the absorbing medium, and a layer incorporating an ionic surfactant is overlaid onto the polymer. The surfactant also may be placed in a layer between the polymer and the absorbing medium. A preferred absorbing medium is silver bromide. With silver bromide, the absorbing medium becomes selective for iodide and does not remove bromide ions or chloride ions if present in the fixer bath. These ions are less harmful to fixing than iodide and usually need not be removed. However, if it is desired to remove iodide or bromide from the fixing solution, an absorbing medium such as silver chloride can be used. Preferred polymers are copolymers of combinations of two or more methacrylate, methacrylamide, acrylate, or acrylamide monomers in which at least one monomer is cationic and the others are nonionic. Preferred surfactants are anionic surfactants, in particular, a mixture of sodium di- and tri-isopropylnaphthalenesulfonates sold commercially as Alkanol® XC, and a sodium sulfosuccinate diester, sold commercially as Aerosol® OT. See surfactant section. The preferred fixing agent in the fixer bath is thiosulfate.

MODES FOR CARRYING OUT THE INVENTION

The invention has numerous advantages over prior articles and processes for removal of iodide from thiosulfate-containing fixer solutions. Previous methods were not selective for iodide and would remove significant amounts of bromide, silver, and thiosulfate. Furthermore, previous methods required expensive electrical equipment and expensive membranes, which are prone to clogging. The ability to remove iodide selectively 1) increases the absorptive capacity of the article for iodide, 2) enables a wide selection of iodide removing materials to be used, and 3) extends the fixer bath useful life without also removing significant amounts of other ions from the bath. These other ions may be desired to be left in the fixer bath (sulfite and thiosulfate) or to be removed by some other efficient means (silver by various other known methods, electrolysis, for example). The polymers of the invention are selectively permeable to iodide in preference to thiosulfate and, therefore, allow removal of iodide without depleting the thiosulfate in the fixer solution. These and other advantages will be apparent from the consideration of the description below.

Figure 1:
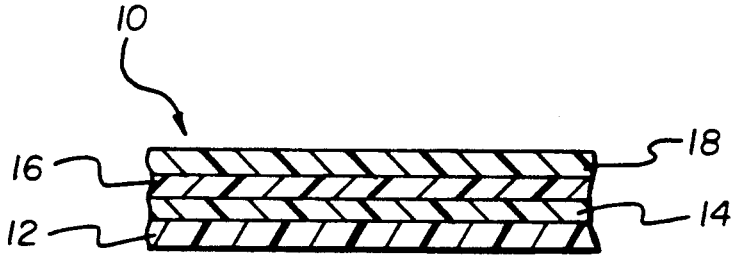
FIGS. 1 through 3 are cross-sectional views of the iodide removal members of the invention formed on a substrate.

In FIG. 1 is illustrated in cross-section a portion of an iodide removal member of the invention. The article 10 is comprised of a substrate 12 of a material that is impermeable to and not affected by bleach-fix or fixer solution such as a polyester film. Onto the substrate 12 has been placed an iodide absorbing medium 14. The iodide absorbing medium is preferably formed of silver bromide in gelatin. Overlaying the iodide absorbing medium layer is the ionic polymer layer 16. This layer preferably is formed of a copolymer of vinyl monomers in which one portion of the copolymer is ionic and hydrophilic, and the other is nonionic and hydrophilic or hydrophobic. Overlaying the ionic polymer is an ionic surfactant layer 18 that optionally may include a coating vehicle such as gelatin, together with the surfactant. The surfactant serves to modify the permeability of the polymer layer. The surfactant has a charge opposite to that of the polymer. Optionally, the structure of layers 14, 16, and 18 can be coated on both sides of the support 12.

Figure 2:
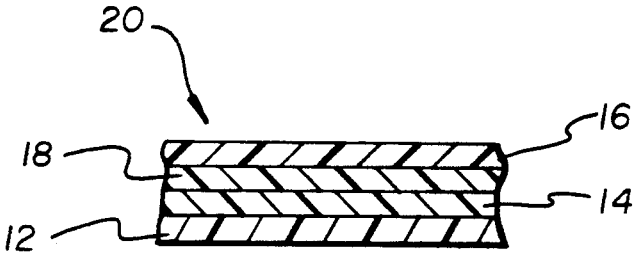

Illustrated in FIG. 2 is an alternative iodide ion removing article 20. This article is composed of a substrate 12, the iodide absorbing medium 14, the surfactant containing layer 18 and the iodide ion permeable polymer layer 16. In this structure the surfactant layer is placed adjacent to the iodide absorbing medium with the polymer layer exposed to the fixer solution. Optionally, the structure of layers 14, 18, and 16 can be coated on both sides of the support 12.

Figure 3:
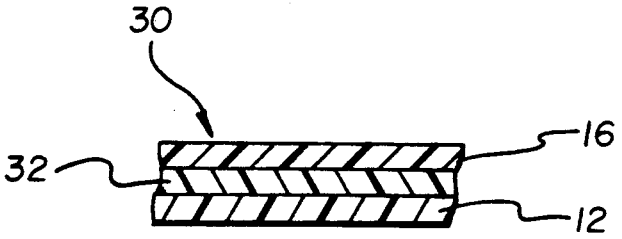

FIG. 3 illustrates another embodiment 30 of the invention also formed on a substrate 12. Substrate 12 is coated with a layer of iodide absorbing medium 32 that has further incorporated therein a surfactant. Overlaying the composite layer 32 of iodide absorbing medium and surfactant is the layer of iodide ion permeable polymer 16. Optionally, the structure of layers 32 and 16 can be coated on both sides of the support.

Optionally, in articles 10 and 20, the contents of layers 18 and 16 can be combined and coated as a single layer, but it is generally preferred not to do so.

Figure 4:
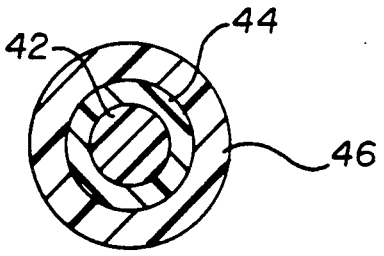
FIGS. 4 and 5 are cross-sectional views of encapsulated materials forming the iodide removal articles of the invention.

Rather than being cast on the substrate, it is also within the invention that the articles for iodide removal be formed of encapsulated materials. As illustrated in FIG. 4, the particle 40 is formed of a core 42 of iodide absorbing medium such as silver bromide, optionally in gelatin. This core 42 is overcoated with a layer of ionic polymer 44 which is in turn overcoated with layer 46 of an ionic surfactant, of a charge opposite to that of the polymer which also may be combined with gelatin in the layer 46.

Figure 5:
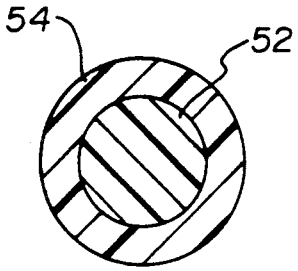

FIG. 5 illustrates another embodiment of the invention in which a particle 50 is formed that is comprised of a core 52 that is composed of a composite of iodide absorbing medium, such as silver bromide and an ionic surfactant. The core 52 is overlayed by layer 54 comprising the ionic polymer, with a charge opposite to that of the surfactant.

Iodide is removed from the fixer bath simply by contacting the fixer bath solution with the iodide-removing article.

Figure 6:
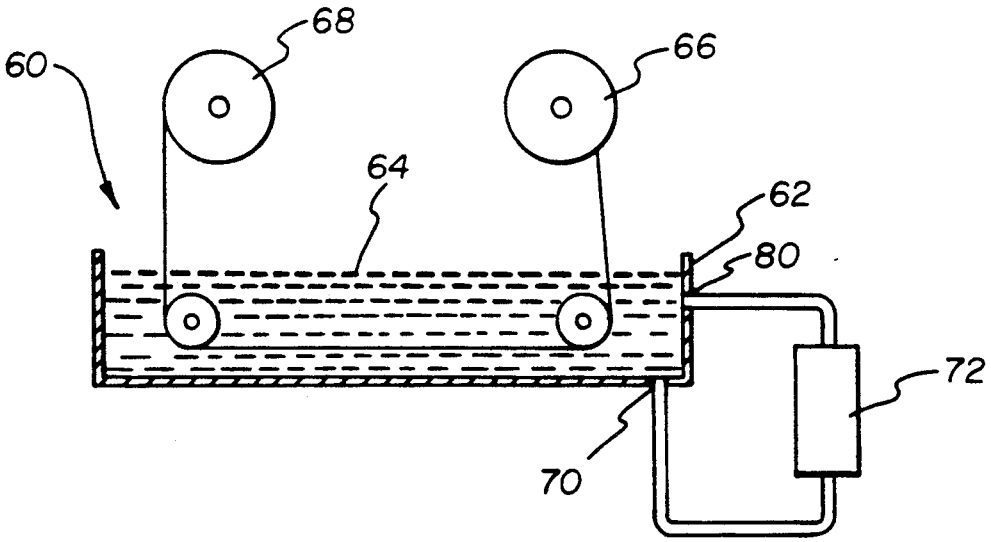
FIG. 6 is a schematic view of apparatus suitable for the process of the invention.

In FIG. 6 is illustrated schematically an apparatus utilizing iodide ion removal articles in accordance with the invention. Apparatus 60 is composed of a fixer bath tank 62 containing fixer bath 64. Rolls 66 and 68 illustrate the article of the invention in sheet form that may be unrolled from roll 68 and passed through the bath 64 and rewound on roll 66. The rate of movement through the bath may be adjusted such that complete conversion of the silver bromide to silver iodide in the iodide absorbing articles is achieved. Bath outlet 70 is designed such that it may carry the fixer bath solution 64 through canister 72 after which it is returned to the bath 62 through bath inlet 80. Canister 72 may contain a coiled or wound ion absorbing sheet. In the alternative, it may contain particles of iodide absorbing medium such as illustrated in FIGS. 4 and 5. The material in the canister, if in sheet form, would be coiled or wound in order to maximize the amount of surface area available for liquid treatment as the fixer solution is pumped through the canister, by pump not shown.

The invention provides a way of removing iodide ion from a seasoned fixer bath without the need for complicated electrical or membrane systems, which are susceptible to clogging, and which may require specially trained personnel in order to be properly operated. It has been known that the removal of iodide was possible by the exchange of chloride or bromide from silver chloride or silver bromide, respectively. The difficulty with such an exchange in the fixer bath is that the fixing agent in the bath also reacts with and dissolves silver bromide, silver chloride, and silver iodide. The invention provides a solution to this problem.

The fixer baths that are treated by the iodide-absorbing elements of this invention are those that are generally used for the fixing of silver-halide based photographic materials, particularly those containing silver iodide, silver bromoiodide, silver chloroiodide, and silver chlorobromoiodide emulsions. Many such fixer bath formulations are known.

Examples of fixer bath formulations may be found in *Encyclopedia of Practical Photography,* Vol. 6, Eastman Kodak Co., ed., Amphoto, Garden City, N.Y., 1978, pp. 1086–1091; *Photographic Processing Chemistry,* Focal Press, London, 1966; *Processing Chemicals and Formulas,* Publication J-1 Eastman Kodak Company 1973; and *PhotoLab Index,* Lifetime Edition, Morgan and Morgan, Inc., Dobbs Ferry, N.Y., 1987; and *Imaging Handbook of Photography and Reprography Materials, Processes and Systems,* Van Nostrand Reinhold Company, 7th Ed., 1977. Fixer bath formulations may also be found in the references cited in *Research Disclosure,* Item 308119, December 1989, pp. 1010.

The fixer bath comprises an aqueous solution of a thiosulfate salt of ammonium, sodium, potassium, or calcium ions, and the like, or mixtures of these salts as a fixing agent. Thiosulfate salts are generally preferred as fixing agents because they are inexpensive, easily prepared and purified, highly soluble, non-toxic, non-odorous, stable over a wide pH range in the fixer bath, and they form very stable and soluble reaction products with silver ion and silver halides. Furthermore, these stable, soluble reaction products remain stable under the more dilute solution conditions of subsequent washing or stabilizing operations, thereby precluding the reprecipitation of silver salts in the silver halide photographic materials. Thiosulfate salts are relatively nonreactive toward image silver or photographic image dyes and non-reactive toward the gelatin commonly used in photographic films and papers.

Other characteristics of the fixer bath are those that are typical of fixer baths in the art. For example, the concentration of thiosulfate in the fixer bath can be from about 0.05M to as high as solubility in the processing solution allows, but it is preferred that this concentration be from about 0.1M to 2M. The pH of the fixer bath may range from about 3 to as high as about 12, but it is generally preferred that the pH be between 4 and 10. The fixer bath can optionally contain a source of sulfite or bisulfite ion. If the fixer bath is to be used at a pH below about 7, it is preferred to include a source of sulfite or bisulfite ion in the fixer solution. For example, sodium or potassium sulfite, sodium or potassium bisulfite, or sodium or potassium metabisulfite can be used. The concentration of this source of sulfite or bisulfite ion is generally from about 0.01M to about 0.5M. To control solution pH, various buffering agents may be used in the fixer bath, including the above-mentioned sulfite or bisulfite sources, acetate salts, various ammonium salts, citrates, tartrates, borates, carbonates, phosphates, etc.

If a film-hardening action is desired for the fixer bath, it may contain one or more ingredients to effect film hardening and to stabilize the hardening agent in the fixer bath. Such ingredients include potassium alum, aluminum sulfate, aluminum chloride, boric acid, sodium tetraborate, gluconic acid, tartaric acid, citric acid, acetic acid, and sodium acetate.

The fixer bath may contain one or more substances which are known to accelerate film fixing. These materials are described in Chapter 15 of "The Theory of the Photographic Process", 4th Edition, T. H. James, ed., MacMillan, N.Y., 1977. Such substances include ammonium salts, such as ammonium chloride, ethylenediamine, and other amines, such as guanidine.

The fixer bath may also contain compounds for the prevention of precipitation of metal salts of metals that are initially present in or that become introduced into the fixer bath during use. Such metals include iron, copper, zinc, magnesium, calcium, aluminum, and chromium, among others. Metal sequestering agents, chelating agents, and precipitation control agents may be used to control these metals. Examples of these metal control agents are polycarboxylic acids such as citric acid and tartaric acid; aminocarboxylic acids such as nitrilotriacetic acid, ethylenedinitrilotetraacetic acid (EDTA), and diethylenetriaminepentaacetic acid; organophosphonic acids such as nitrilotris(methylenephosphonic) acid and 1-hydroxyethylidene-1,1-diphosphonic acid; ortho-dihydroxybenzene compounds such as 4,5-dihydroxy-m-benzenedisulfonic acid; acyclic or cyclic polyphosphates; and various polymers such as polyacrylic acids.

The fixer bath may also contain bleaching agents for the oxidation of developed silver. Such bleaching agents must be compatible with the fixing agent, thiosulfate ion, and not oxidize it. This combination of a bleaching agent and fixing agent into a single processing solution is known as a bleach-fix bath. A common bleaching agent for this purpose is the iron(III) chelate, [ethylenedinitrilotetraacetatoferrate(III)], $FeEDTA^-$, typically used as the ammonium, sodium, or potassium salt. This chelate and other chelates of iron with aminocarboxylate chelating agents and polycarboxylic acid chelating agents may be used in bleach-fix baths. Bleaching agents for use in thiosulfate-containing bleach-fix baths are well known in the art.

The thiosulfate ion of the fixer solution tends to pass through the same medium that the iodide ion can pass through, making separation of iodide from thiosulfate difficult. Therefore, the general practice has been to replenish or replace fixer bath solutions rather than try to prolong the life of the fixer solution by removing iodide ion. The polymers of the instant invention allow the passing of the iodide ion without passage of any substantial amount of thiosulfate ion. This is accomplished without having to apply external electrical forces, as is required in electrodialysis.

The polymer utilized in the invention may be any polymer that is permeable to iodide ion that is coatable. The preferred polymers contain a hydrophilic ionic component and a nonionic component. The polymer must be a copolymer comprised of at least two or more polymer groups. The preferred polymers of the invention are those represented by the general Formula 1:

$$-(A)_x-(B)_y-(D)_z \qquad (1)$$

wherein x designates 0 to 99.9 mole percent, y designates 0.1 to 30 mole percent, z designates 0 to 99.9 mole percent, and $x+y+z=100$ mole percent. (A) represents recurring units derived from one or more nonionic hydrophobic vinyl monomers of the general Formula 2:

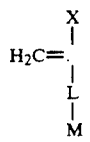

(2)

wherein:

X=H, $CH_3$

L=a single bond,

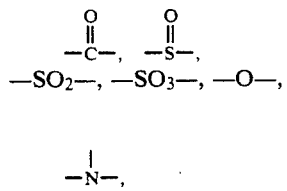

Arylene, Alkylene,

C=N—, —S—, nitrilo, and heterocyclyl containing one or more N, O, S; combination of these groups.

and combinations of the above groups described as α with alkylene chains.

M=—OR, —SR, —NHR, $—NR_1R_2$, —R,

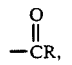

wherein R, $R_1$, and $R_2$ represent:

(a) straight-chain or branched-chain alkyl substituents having 1 to 15 carbons, (b) arylene substituents, (c) heterocyclic substituents containing one or more N, S, O, (d) any of the groups described in (a) through (c) above having one or more sites of unsaturation, (e) any of the groups described in (a) through (d) above in which hydrogen is substituted with one or more fluorine, chlorine, bromine, iodine, alkoxy, acyloxy, alkylsulfoxy, alkylsulfonyl, nitro, thio, keto, or nitrile groups, and (f) combinations of the groups described in (a) through (e) above. Representative hydrophobic monomers A include but are not limited to butyl acrylate, butyl methacrylate, styrene and substituted styrenes, N-t-butylacrylamide, N-t-butylmethacrylamide, N-isopropylacrylamide, and N-isopropylmethacrylamide.

B in general Formula 1 represents recurring units of one or more hydrophilic ionic vinyl monomers of the general Formula 3, wherein X and L represent groups listed above under Formula 2,

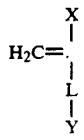

(3)

and wherein:

Y=an ionic group including heterocyclic ionic groups such as imidazolium, thiazolium, pyridinium, as well as ionic groups such as $—NH_3^+$, $—NH_2R^+$, $-NHR_1R_2^+$, $-NR_1R_2R_3^+$, $=NR_1R_2^+$, $-CO_2^-$, $-SO_2^-$, $-SO_3^-$, $-O^-$, $-OPO_3^{-2}$ and $-SR_2^+$, wherein R, $R_1$, $R_2$, $R_3$=straight- or branched-chain alkyl of 1 to 10 carbons, and associated counterions of these ionic groups, e.g., halide, alkali metal, ammonium, etc.

It should be understood from the general description that the hydrophilic monomer B can be selected from any class of vinyl monomer having an ionic group that can undergo free radical polymerization, including vinyl ketones, N-vinyl amides, N-vinyl lactams, vinyl imidazoles, vinyl pyridines, vinyl sulfones, vinyl ethers, vinyl esters, vinyl urylenes, vinyl urethanes, vinyl nitriles, vinyl anhydrides, vinyl imines, vinyl imides, vinyl halides, vinyl aldehydes, styrenes and substituted styrenes, vinyl naphthalenes, vinyl heterocycles containing oxygen, nitrogen, or sulfur and combinations of these heteroatoms, acrylamides, methacrylamides, acrylates, and methacrylates. Representative monomers B include but are not limited to sodium acrylate, 2-aminoethyl acrylate hydrochloride, 2-aminoethyl methacrylate hydrochloride, N-(3-aminopropyl)methacrylamide hydrochloride, p-styrenesulfonic acid sodium salt, N-(3-dimethylaminopropyl)methacrylamide hydrochloride, 2-aminoethyl vinyl ether hydrochloride, 2-aminoethyl styryl ether hydrochloride, 4-vinylpyridine hydrochloride, 2-vinylpyridine hydrochloride, N-vinylimidazole hydrochloride, N-alkyl-2-vinylimidazole hydrochlorides, N-alkyl-4-vinylimidazole hydrochlorides, N-alkyl-5-vinylimidazole hydrochlorides, and N-(2-sulfo-1,1-dimethylethyl)acrylamide sodium salt. In addition, B in Formula 1 can be derived from vinyl monomers known to undergo free radical polymerization which can undergo a subsequent reaction resulting in the formation of an ionic group, e.g., by hydrolysis, or by pH induced protonation or deprotonation. It should also be understood that Y in general Formula 3 can contain one or more ionic groups of similar or opposite charge.

Other examples of anionic and cationic monomers are listed in *Research Disclosure* 19551, July 1980.

A or B in Formula 1 may be partially substituted by D in Formula 1 wherein D may represent either:

(a) one or more hydrophilic ionic monomers of Formula 3 having the same or opposite charge as B in Formula 1, or one or more hydrophilic nonionic vinyl monomers not represented by Formula 3. The substitute nonionic hydrophilic vinyl monomers may comprise up to 99.9 mole percent, as long as the ionic content represented by B is present in at least 0.1 mole percent. If D is ionic, then the combined amount of B and D in the polymer is preferably less than or equal to 30 mole percent ($y+z \leqq 30$ mole percent). The substitute ionic or nonionic hydrophilic vinyl monomers can be selected from virtually any class of vinyl monomer capable of undergoing free radical polymerization. Representative monomers include but are not limited to acrylamide, N-methylacrylamide, N,N-dimethylacrylamide, 2-hydroxyethyl acrylate, 2-hydroxyethyl methacrylate, 2-hydroxypropyl acrylate, 2-hydroxypropyl methacrylate, N-(2-hydroxyethyl)methacrylamide, N-(2-hydroxyethyl)acrylamide, and N-(2-hydroxypropyl)methacrylamide. See *Research Disclosure* 19551 for other examples. The substitute ionic or nonionic monomers may also be derived from any other monomer used to make the polymer, which can include hydrophilic monomer B of Formula 1 or hydrophobic monomer A of Formula 1, either by subsequent pH induced change in ionization or chemical modification of the polymer after polymerization.

(b) one or more hydrophobic nonionic monomers represented by general Formula 2 or one or more hydrophobic nonionic monomers not represented by Formula 2, to an extent generally less than 50 mole percent. These can be selected from any class of vinyl monomer capable of undergoing free radical polymerization. They may also be derived from any other monomer used to make the polymer either by subsequent chemical modification of the polymer or by pH induced change in ionization to give an uncharged rather than ionic form. The substitute hydrophobic monomer D may be one that is either insoluble in water, or forms homopolymers that are insoluble in water, or forms homopolymers that exhibit inverse temperature solubility properties (precipitate on heating in solution).

Polymers may be coated or applied as aqueous solutions, as solutions in organic solvents, such as methanol, ethanol, acetone, ethyl acetate, and the like, or as latexes in aqueous solutions. Solutions may also consist of mixtures of water with one or more miscible organic solvents such as methanol, ethanol, or acetone, for example. Preferred polymers have been found to be butyl methacrylate-co-2-aminoethyl methacrylate hydrochloride-co-2-hydroxyethyl methacrylate, and isopropylacrylamide-co-(N-3-aminopropyl)methacrylamide hydrochloride, as these materials display good permeability to iodide and low permeability to thiosulfate when surfactant treated.

The surfactant may be any surfactant that will modify the permeability of the polymer to reduce permeability to thiosulfate while maintaining permeability to halide ions. If the ionic group Y of hydrophilic monomer B of the polymers of this invention is a cationic group, it is preferred that one or more anionic surface active agents (surfactants) be introduced either (1) in a layer underneath this polymer layer, (2) in a layer overlying this polymer layer, (3) together with the polymer, or 4) some combination of these three methods. It is most preferred to introduce the surface active agents by method (1), method (2), or a combination of methods (1) and (2).

Anionic surface active agents which may be used in this invention can be represented by general Formula (I):

$$R_1(O)_{n-1}SO_3M \qquad (I)$$

where $R_1$ represents a hydrophobic group having 6 to 40 carbon atoms, M represents a cation, and n represents 1 or 2.

The hydrophobic group having 6 to 40 carbon atoms, represented by $R_1$ in general Formula (I) includes a saturated or unsaturated, aliphatic or aromatic, straight-chain or branched-chain hydrophobic group. The hydrophobic group can be a group containing only carbon atoms or a group containing carbon, nitrogen, oxygen, or sulfur atoms in the hydrophobic chain and halogens, particularly, fluorine atoms, on the hydrophobic chain. For example, the hydrophobic chains can be interrupted by an ether bond, a thioether bond, and amino bond, an amido bond, an ester bond, a sulfonyl bond, etc. or by two or more of these types of bonds. The hydrophobic group $R_1$ may also contain a hydrophilic group such as $O_{n-1}SO_3M$, or $CO_2M$, where n represents 1 or 2 and M represents a cation, provided that this hydrophilic group is in proximity to the $O_{n-1}SO_3M$ group of general Formula (I). Of the compounds of this type, patent literature references to many examples are given in *Research Disclosure,* Item 308119, December 1989, pp. 1005–1006. Many are also described in detail in *McCutcheon's Emulsifiers and Detergents,* MC Publishing Co., 1987. A preferred carbon chain length range is 6 to 30 carbon atoms. Suitable examples of groups for $R_1$ include hexyl, octyl, dodecyl, octadecyl, $-C_8F_{17}$, etc. Classes of anionic surface active agents that include members that can be useful in this invention are:

1) alkane sulfonates
2) alcohol sulfates (alkylsulfuric acid esters)
3) ether alcohol sulfates
4) sulfated polyol esters
5) sulfated alkanolamides
6) sulfated amides
7) sulfated esters
8) sulfonated esters
9) alkylated arylsulfonates (for example, alkylbenzene and alkylnaphthalene sulfonates)
10) olefin sulfonates
11) sulfopolycarboxylic esters
12) sulfoalkylesters of fatty acids
13) sulfoalkylamides of fatty acids
14) sulfated monoglycerides
15) sulfated fat or oil with a free carboxyl group
16) α-sulfocarboxylic acids Specific examples of surface active agents represented by general Formula (I) which can be used in the present invention are illustrated as follows:

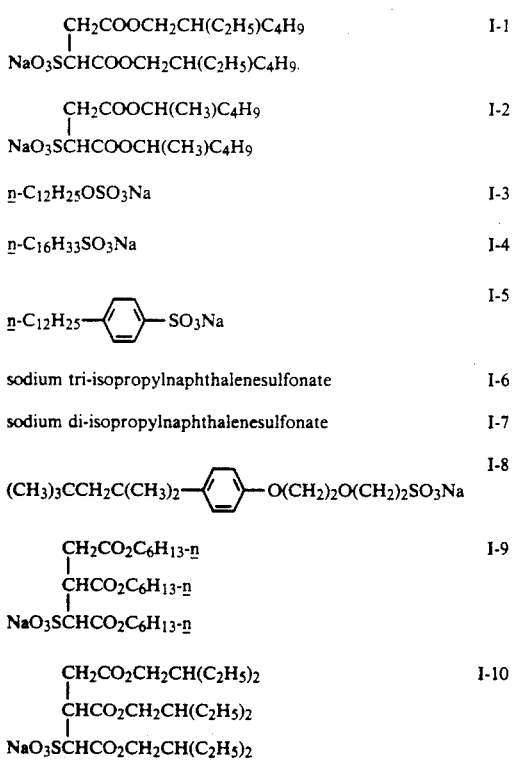

The cation represented by M in general Formula (I) includes cations such as hydrogen atom, an alkali metal atom (such as lithium, sodium, or potassium), and an ammonium group (such as ammonium, tetramethylammonium, tetraethylammonium, diethanolammonium, morpholinium, pyridinium, etc.).

Alternatively, the anionic surface active agents which may be used in this invention can be represented by general Formulas (II), (III), and (IV):

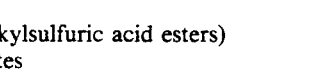

$$R_1CO_2M \quad \text{(II)}$$

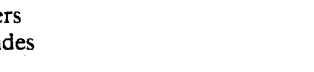

$$R_1OP(O)(OM)_2 \quad \text{(III)}$$

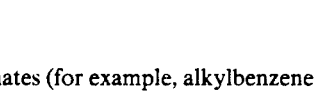

$$R_1OP(O)OR_2OM \quad \text{(IV)}$$

where $R_1$ represents a hydrophobic group having 6 to 40 carbon atoms, and M represents a cation. $R_2$ can be identical to $R_1$ or chemically of the same general description as $R_1$ given below, or optionally it can be an organic group having 1 to 5 carbon atoms, in either a straight- or branched-chain.

The hydrophobic group having 6 to 40 carbon atoms, represented by $R_1$ in general Formulas (II), (III), and (IV) includes a saturated or unsaturated, aliphatic or aromatic, straight-chain or branched-chain hydrophobic group. The hydrophobic group can be a group containing only carbon atoms or a group containing carbon, nitrogen, oxygen, or sulfur atoms in the hydrophobic chain and halogens, particularly, fluorine atoms, on the hydrophobic chain. For example, the hydrophobic chains can be interrupted by an ether bond, a thioether bond, and amino bond, an amido bond, an ester bond, a sulfonyl bond, etc. or by two or more of these types of bonds. Many compounds of these types are also described in detail in *McCutcheon's Emulsifiers and Detergents,* MC Publishing Co., 1987. A preferred carbon chain length range is 6 to 30 carbon atoms. Suitable examples of groups for $R_1$ include hexyl, octyl, dodecyl, octadecyl, $-C_8F_{17}$, etc. Examples of anionic surface active agents that are described by general Formula (II) are any of the salts of various fatty acids such as oleic acid and stearic acid, and other hydrophobic carboxylic acids such as the alkylphenoxypoly(ethyleneoxy)acetic acids.

Examples of anionic surface active agents that are described by general Formulas (III) and (IV) are:

(1) alkoxypoly(ethyleneoxy)ethyl phosphates
(2) alkylphenoxypoly(ethyleneoxy)ethyl phosphates
(3) bis[alkoxypoly(ethyleneoxy)ethyl] phosphates The cation represented by M in general Formulas (II), (III), and (IV) includes cations such as hydrogen atom, an alkali metal atom (such as lithium, sodium, or potassium), and an ammonium group (such as ammonium, tetramethylammonium, tetraethylammonium, diethanolammonium, morpholinium, pyridinium, etc.).

It is not necessary to use a single anionic surface active agent in the practice of this invention. A mixture of two or more anionic surface active agents may be used, and nonionic surface active agents may be present together with the anionic surface active agents.

If the ionic group Y of hydrophilic monomer B of the polymers of this invention is an anionic group, it is preferred that one or more cationic surface active agents be introduced either (1) in a layer underneath this polymer layer, (2) in a layer overlying this polymer layer, (3) together with the polymer, or (4) some combination of these three methods. It is more preferred to introduce the surface active agents by method (1), method (2), or a combination of methods (1) and (2).

Such cationic surface active agents may be represented by general Formulas (V), (VI), and (VII):

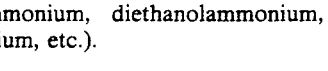

$$[R_1ZR_2R_3R_4]^+10^3\,X^- \quad \text{(V)}$$

$$[R_1R_2ZR_3R_4]^+ 10^3 X^- \quad (VI)$$

$$\{R_1R_2R_3ZR_4]^+ 10^3X^- \quad (VII)$$

where Z=nitrogen or phosphorous, and where $R_1$ in general Formula (V), $R_1$ and $R_2$ in general Formula (VI), and $R_1$, $R_2$, and $R_3$ in general Formula (VII) represent a hydrophobic group having 4 to 40 carbon atoms. X represents an anion. $R_2$, $R_3$, and $R_4$ in general Formula (V), $R_3$ and $R_4$ in general Formula (VI), and $R_4$ in general Formula (VII) represent a hydrogen atom, or a straight-chain or branched-chain alkyl group with less than about 4 carbon atoms. Alternatively, $R_2$, $R_3$, and $R_4$ can represent the atoms necessary to form a saturated or unsaturated, five- or six-membered ring (which may include some of the atoms of $R_1$), which may contain, in addition to the necessary carbon atoms, one or more heteroatoms such as nitrogen, oxygen, and sulfur. The groups, $R_2$, $R_3$, and $R_4$ which contain less than about 4 carbon atoms, can also contain one or more heteroatoms such as nitrogen, oxygen, and sulfur, and can have one or more halides attached, such as chlorine or fluorine.

The hydrophobic group having 4 to 40 carbon atoms, represented by $R_1$ in general Formula (V), $R_1$ and $R_2$ in general Formula (VI), and $R_1$, $R_2$, and $R_3$ in general Formula (VII) includes a saturated or unsaturated, aliphatic or aromatic, straight-chain or branched-chain hydrophobic group. The hydrophobic group can be a group containing only carbon atoms or a group containing carbon, nitrogen, oxygen, or sulfur atoms in the hydrophobic chain and halogens, particularly, fluorine atoms, on the hydrophobic chain. For example, the hydrophobic chains can be interrupted by an ether bond, a thioether bond, and amino bond, an amido bond, an ester bond, a sulfonyl bond, etc. Many typical cationic surface-active agents are described in detail in *McCutcheon's Emulsifiers and Detergents,* MC Publishing Co., 1987. A preferred carbon chain length range is 4 to 30 carbon atoms. Suitable examples of hydrophobic groups include butyl, hexyl, octyl, dodecyl, hexadecyl, octadecyl, $-C_8F_{17}$, etc. Examples of groups for $ZR_2R_3R_4$ in general Formula (V) include $NH_3$, $N(CH_3)_3$, pyridine, morpholine, $N(CH_3)_2CH_2CH_2OH$, etc. Examples of $X^-$ are chloride, bromide, sulfate, nitrate, etc.

Examples of cationic surface active agents that can be useful in this invention are hexadecyltrimethylammonium bromide, hexadecylpyridinium bromide, benzyldimethylhexadecylammonium chloride, dodecyltrimethylammonium chloride, dodecylammonium chloride, tetradecyltrimethylammonium bromide, benzethonium chloride, fatty acid derivatives of imidazoline alkyl halide salts, fatty acid amidoalkylammonium salts, and the like.

It is not necessary to use a single cationic surface active agent in the practice of this invention. A mixture of two or more cationic surface active agents may be used, and nonionic surface active agents may be present together with the cationic surface active agents.

Ionic surfactants may also be applied to the article by contacting the article with a solution containing the ionic surfactant (0.1-20% by weight is typical range of surfactant concentration that can be used in the solution). Immersion of the article into a solution of ionic surfactant for a necessary length of time can be a useful means of applying the surfactant.

Preferred ionic surfactants have been found to be a mixture of I-7 and I-6, commercially available as Alkanol® XC (manufactured by DuPont Co.), and I-1, commercially available as Aerosol® OT (manufactured by American Cyanamide Co.).

The absorbing material that will absorb iodide ions that pass through the surfactant-treated selectively permeable polymer may be any material or combination of materials compatible with the environment of the fixer bath that will absorb, adsorb, oxidize, or exchange iodide ions. This material should not be able to permeate the overlying polymer, and it should prevent iodide ion or the reaction products from iodide ion from re-entering or entering the fixer solution. Suitable iodide absorbing materials which may be used for this invention include:

(1) Silver compounds, including but not limited to, silver chloride, silver bromide, silver chlorobromide, silver chloroiodide, silver bromoiodide, and silver thiocyanate. Methods for the preparation of such materials are widely known and published, for example, in *Research Disclosure,* Item 17643, December 1978; Item 29963, March 1989; and Item 308119, December 1989.

(2) Insoluble bismuth compounds, such as bismuth hydroxide and bismuth(III) oxide, as described in U.S. Pat. No. 4,010,034.

(3) Anion-exchange resins, such as Dowex® anion-exchange resins manufactured by Dow Chemical Company, Midland, Mich., and Amberlite® anion-exchange resins manufactured by Rohm and Haas Co., Philadelphia, Pa. Preferably, these resins would be used in a form with good affinity for iodide ion, such as in a chloride or bromide form, most preferably chloride. Other examples of anion exchange resins may be found in European Patent Application 0 348 532 of Ueda et al.

(4) Coatable anion-exchange polymers or latexes. Examples of such materials are the cationic polymers in the references cited under "VII. Color Materials: Dye Fixing Layer" in *Research Disclosure,* Item 29963, March 1989. Other examples can be found in the references cited in "XXIII. Image-transfer Systems" of *Research Disclosure,* Item 308119, December 1989. The useful polymers are the cationic polymers used to mordant anionic dyes in image transfer systems. These cationic polymers and latexes should absorb iodide, when used in a form with good affinity for iodide ion. This would preferably be a chloride or bromide form, most preferably chloride. Other examples of coatable anion exchange polymers and latexes can be found in U.S. Pat. No. 4,948,711 of Kojima et al, in European Patent Application 264 847, and in U.S. Pat. No. 4,812,391 of Toya et al.

For maximum iodide capacity and selectivity over bromide, which can also be present in seasoned fixer baths, it is preferred to use silver chloride, silver bromide, or silver thiocyanate, most preferably silver bromide.

It is preferred that the layer(s) of the element containing the iodide absorbing material [generally referred to as iodide-absorbing layer(s)] be hydrophilic. The iodide-absorbing material should itself be hydrophilic or, alternatively, it should be mixed with a hydrophilic water permeable colloid to make the medium hydrophilic. Such colloids are described as vehicles and vehicle extenders in *Research Disclosure,* Item 17643, December 1978, and Item 308119, December 1989, and as vehicles/binders in *Research Disclosure,* Item 29963, March 1989.

If the iodide-absorbing materials are coated onto a support material, any of various hydrophilic water permeable colloids may be used either alone or in combination as coating vehicles or vehicle extenders. These colloids include gelatin and other proteins such as albumin, or polysaccharides and cellulose derivatives. These and other suitable hydrophilic colloids are described in *Research Disclosure,* Item 17643, December 1978; Item 29963, March 1989; and Item 308119, December 1989. The coated layers can also contain alone or in combination with the above-mentioned hydrophilic water permeable colloids as vehicle extenders, synthetic polymeric peptizers, carriers, or binders as described in the above-mentioned *Research Disclosure.*

Other coated layers of the iodide-absorbing element can contain the above-mentioned hydrophilic colloid vehicles or vehicle extenders, and polymeric peptizers, carriers, or binders.

Layers of the iodide-absorbing element that contain cross-linkable vehicles or vehicle extenders can be hardened or cross-linked by various organic and inorganic hardeners, either alone or in combination, as described in *Research Disclosure,* Item 17643, December 1978, and Item 308119, December 1989.

The iodide-absorbing layer(s) can contain various types of coating aids (i.e., wetting agents), such as those described in *Research Disclosure,* Item 17643, December 1978, and Item 308119, December 1989. These are generally anionic, cationic, nonionic, or zwitterionic surface active agents (surfactants), which may be used alone or in combination. However, if the polymer layer that covers the iodide-absorbing layer is a cationic polymer, it is preferred that the coating aids, if used to help coat or apply that layer, be nonionic, zwitterionic, or cationic. Similarly, if the polymer layer that covers the iodide-absorbing layer is an anionic polymer, it is preferred that the coating aids, if used to help coat or apply that layer, be nonionic, zwitterionic, or anionic. If the polymer layer that covers the iodide-absorbing layer(s) of the element is a cationic polymer, an anionic surfactant that serves as a coating aid for the iodide-absorbing layer(s), or that serves as a coating aid for any layer(s) that are coated around the polymer layer, may constitute part of this invention; that is, a particular anionic coating aid or combination of anionic coating aids for other layers may be used in an amount to make the polymer layer that covers the iodide-absorbing layer(s) selective for iodide permeability so that the absorbing layer(s) absorb iodide more efficiently and selectively.

Preferred coating aids for coating the polymer layers of this invention are Surfactant 10G ® and Zonyl ® FSN. Surfactant 10G is a nonionic surfactant supplied by Olin Corp. It is a nonylphenoxypoly(glycidyl)-glycidol represented as:

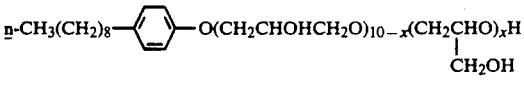

where x is between zero and ten. That is, there are approximately ten glycidyl units in the surfactant molecule, which can be 1,2- or 1,3- linked to each other.

Zonyl ® FSN is a nonionic surfactant manufactured by DuPont Co. It is a fluorinated poly(ethylene oxide) surfactant, represented as:

$$F(CF_2CF_2)_x(CH_2CH_2O)_yH$$

where x is equal to or between 3 and 8 and y is equal to or between 9 and 13. Preferred coating amounts of these coating aids are from 10 to about 50 mg/m$^2$. A preferred mixture of these surfactants is about 20 mg/m$^2$ of Zonyl ® FSN and about 30 mg/m$^2$ of Surfactant 10G. For other coated layers of the iodide removal article, preferred coating aids are Triton ® X 200 and Surfactant 10G. Triton ® X 200 is an anionic surfactant manufactured by Rohm and Haas Co. It is an alkylaryl-polyether sulfonate, represented as:

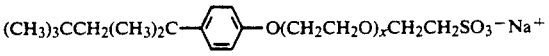

where x is approximately equal to two.

If a material is used to support the iodide-absorbing material and the polymer layer which covers it, the support can be selected from a wide variety of materials. Typical supports could be sheets, films, or particles of metal, wood, paper, glass, rock, organic polymers and plastics such as polyester and cellulose films, or inorganic ceramic materials. It is preferred that the support material be substantially impermeable to and not affected by the fixer solution and its constituents.

The amounts of ionic polymer and of ionic surfactant to be used in the invention can vary with application, and each can be independently varied to give to the article the desired iodide-absorbing qualities. We have found that ionic polymer laydowns of greater than about 0.40 g/m$^2$ are preferred. If the ionic surfactant is coated, laydowns of from 0.01 g/m$^2$ to over 0.30 g/m$^2$ can be useful, but laydowns larger than about 0.10 g/m$^2$ are preferred.

When the articles of invention are presoaked in water and dried prior to use after having been coated and dried initially, a presoaking time of about 10–30 minutes has been satisfactory to produce any improvement in iodide absorbing performance.

Iodide is removed from a fixer bath containing thiosulfate as a fixing agent by contacting the fixer solution with the iodide-absorbing article of this invention. The rate, efficiency, and amount of iodide absorption can be influenced, controlled, and adjusted by many factors: the amounts and nature of iodide absorbing medium used; the amounts and nature of the overlying ionic polymer; the amounts and nature of the ionic surfactant; the surface area of the absorbing article in contact with the fixer solution; the temperature of the fixer solution in contact with the absorbing article; the agitation of the fixing solution in the vicinity of the absorbing material; the concentration of iodide and other constituents in the fixer solution; the length of time the absorbing material is in contact with the fixer solution; the optional process (times and temperatures) of wetting and (optionally) drying the iodide absorbing material before it is brought into contact with the fixer solution. These factors can be changed or modified so as to produce the desired rate of iodide removal from the fixer solution, thereby keeping the iodide concentration in the fixer bath at a suitably low level.

EXAMPLES

Sixteen multilayer coatings with the following structure on a fixer impermeable support were prepared. The coated laydowns are in g/m$^2$. The AgBrI laydown is expressed as g/m$^2$ of Ag. The coatings are listed in Table 1. The base is a cellulose acetate film with a subbing layer of gray silver metal in gelatin. The AgBrI emulsion was prepared using conventional silver halide precipitation methods and contained 6.1 mole percent iodide.

| | |
|---|---|
| 2.69 g gel ± 0.17 g Alkanol ® XC + 0.16 g BVSM (hardnener) | |
| 0.86 g Polymer | |
| 2.15-3.23 g AgBrI | 2.15-3.23 g gel |
| 0.34 g Ag | 2.44 g gel |
| 0.127 mm Acetate Support | |

The top layer also contained, in addition to gelatin and, optionally, the ionic surfactant Alkanol ® XC, a cross-linking (hardening) agent to give greater structural stability to the coated layers. This hardening agent is bis(vinylsulfonyl)methane (BVSM).

TABLE 1

Coatings and Polymers Studied for the Removal of Iodide from Fixer Baths

| Sample Coating | Polymer A/B/D* | Alkanol ® XC 0.17 g/m² | AgBrI g/m² as Ag |
|---|---|---|---|
| 1 (Control) | none | yes | 2.30 |
| 2 (Control) | 50/15/35 wt % | no | 3.00 |
| 3 (Control) | 40/15/45 wt % | no | 2.99 |
| 4 (Control) | 20/15/65 wt % | no | 2.99 |
| 5 | 50/15/35 wt % | yes | 3.00 |
| 6 | 40/15/45 wt % | yes | 2.99 |
| 7 | 10/10/80 wt % | yes | 2.33 |
| 8 | 20/15/65 wt % | yes | 2.22 |
| 9 (Control) | 20/35/45 wt % | yes | 2.92 |
| 10 | 20/25/55 wt % | yes | 2.93 |
| 11 | 30/25/45 wt % | yes | 2.93 |
| 12 | 40/25/35 wt % | yes | 2.91 |
| 13 | 10/20/70 wt % | yes | 2.13 |
| 14 | 20/20/60 wt % | yes | 2.23 |
| 15 | 35/20/45 wt % | yes | 2.23 |
| 16 | 10/15/75 wt % | yes | 2.22 |

*A = butyl methacrylate
B = 2-aminoethyl methacrylate, hydrochloride
D = 2-hydroxyethyl methacrylate

PROCESSING

All processing solutions were at 100° F., and efficiently agitated with air spargers, except for the stabilizer bath, which was not agitated. Each coating (sample size was 35 mm wide and 150-300 mm long) was subjected to the following process:

| | |
|---|---|
| Tap Water Presoak | 10.25 min. |
| Fixer Bath | 1 min. |
| Tap Water Wash | 3 min. |
| Stabilizer | 1 min. |

The coatings were then dried in air. The fixer baths had the following compositions for one liter of solution:

| | |
|---|---|
| Fixer Bath 1 | |
| Ammonium Thiosulfate solution (56.5% ammonium thiosulfate, 4% ammonium sulfite[wt]) | 162 ml. |
| Sodium Metabisulfite | 11.85 g. |
| Sodium Hydroxide (50% solution) to adjust pH to 6.5 | 2 ml. (approx.) |
| Fixer Bath 2 | |
| Ammonium Thiosulfate solution (56.5% ammonium thiosulfate, 4% ammonium sulfite[wt]) | 162 ml. |
| Sodium Metabisulfite | 11.85 g. |

-continued

| | |
|---|---|
| Ammonium Iodide | 7.25 g. |
| Sodium Hydroxide (50% solution) to adjust pH to 6.5 | 2 ml. (approx.) |
| Fixer Bath 3 | |
| Ammonium Thiosulfate solution (56.5% ammonium thiosulfate, 4% ammonium sulfite[wt]) | 162 ml. |
| Sodium Metabisulfite | 11.85 g. |
| Ammonium Iodide | .725 g. |
| Sodium Hydroxide (50% solution), to adjust pH to 6.5 | 2 ml. (approx.) |

After processing, the contents of the coatings were determined by X-ray fluorescence (quantities in g/m² for each element). The results are shown in Table 2. The silver values are corrected by subtracting the grey silver in the coating, which does not react with fixer bath components, from the total amount of silver measured.

Examples 1-3 show that an overcoat containing Akanol ® XC but no polymer layer is ineffective in preventing the fixer bath, with or without iodide, from reacting with and removing silver halide, the iodide ion absorber, from the coating. The coatings therefore fail to remove iodide.

Examples 4-9 show that for the polymer layer compositions A/B/D 50/15/35, 40/15/45 and 20/15/65 (and most likely for the 10/10/80 composition as well) without an overcoat containing Alkanol ® XC, the silver halide is completely removed from the coating by the fresh fixer bath containing no iodide, an undesirable result. The fixing agent is able to gain access to the iodide absorbing medium, eliminating its ability to trap or react with iodide (if it was present in the fixer bath) in this case by reacting with and removing the iodide absorbing medium.

TABLE 2

Contents of Coatings Contacted With Fixer Baths For 1 Minute

| Example | Sample Coating | Fixer Bath | Silver | Iodide |
|---|---|---|---|---|
| 1 (control) | 1 comparison | None | 2.30 | 0.16 |
| 2 (control) | 1 comparison | 1 | 0 | 0 |
| 3 (control) | 1 comparison | 2 | 0 | 0 |
| 4 (control) | 2 comparison | None | 3.00 | 0.22 |
| 5 (control) | 2 comparison | 1 | 0 | 0 |
| 6 (control) | 3 comparison | None | 2.99 | 0.22 |
| 7 (control) | 3 comparison | 1 | 0 | 0 |
| 8 (control) | 4 comparison | None | 2.99 | 0.22 |
| 9 (control) | 4 comparison | 1 | 0 | 0 |
| 10 (control) | 5 invention | None | 2.99 | 0.22 |
| 11 | 5 invention | 1 | 3.13 | 0.23 |
| 12 | 5 invention | 2 | 3.11 | 0.60 |
| 13 | 5 invention | 3 | 2.97 | 0.29 |
| 14 (control) | 6 invention | None | 2.99 | 0.22 |
| 15 | 6 invention | 1 | 3.11 | 0.23 |
| 16 | 6 invention | 2 | 3.00 | 0.79 |
| 17 | 6 invention | 3 | 2.99 | 0.34 |
| 18 (control) | 7 invention | None | 2.33 | 0.17 |
| 19 | 7 invention | 1 | 2.23 | 0.17 |
| 20 | 7 invention | 2 | 2.23 | 2.44 |
| 21 | 7 invention | 3 | 2.05 | 0.76 |
| 22 (control) | 8 invention | None | 2.22 | 0.15 |
| 23 | 8 invention | 1 | 1.92 | 0.16 |
| 24 | 8 invention | 2 | 1.82 | 1.99 |
| 25 | 8 invention | 3 | 0.86 | 0.56 |
| 26 (control) | 9 comparison | None | 2.92 | nd |
| 27 | 9 comparison | 1 | 0 | nd |
| 28 (control) | 10 | None | 2.93 | nd |
| 29 | 10 | 1 | 0 | nd |
| 30 (control) | 11 | None | 2.93 | nd |
| 31 | 11 | 1 | 0 | nd |
| 32 (control) | 12 | None | 2.91 | nd |
| 33 | 12 | 1 | 0 | nd |
| 34 (control) | 13 | None | 2.13 | nd |

TABLE 2-continued

| Contents of Coatings Contacted With Fixer Baths For 1 Minute | | | | |
|---|---|---|---|---|
| Example | Sample Coating | Fixer Bath | Silver | Iodide |
| 35 | 13 | 1 | 0 | nd |
| 36 (control) | 14 | None | 2.23 | nd |
| 37 | 14 | 1 | 0 | nd |
| 38 (control) | 15 | None | 2.23 | nd |
| 39 | 15 | 1 | 1.70 | nd |
| 40 (control) | 16 | None | 2.22 | nd |
| 41 | 16 | 1 | 0.11 | nd |

nd = not determined. quantities of each element are in $g/m^2$

Examples 11, 15, 19 and 23 show that fresh Fixer Bath 1 is much less effective at reacting with and removing silver from coatings containing these same polymer compositions with an overcoat containing Alkanol® XC. When a silver compound is used as the iodide-absorbing medium, it is important that it not be removed from the iodide removal system. Any silver that is removed would add to the seasoned level of silver in the fixer bath and reduce the iodide absorbing capacity of the removal system. For the compositions 50/15/35 and 40/15/45, essentially no silver is removed by the fresh fixer bath in one minute of contact with the fixer bath.

Examples 12, 16, 20 and 24 show that the coatings containing the polymer layers and the Alkanol® XC overcoat absorb substantial amounts of iodide from an iodide-containing (0.05 M) working-strength fixer bath without significant amounts of silver reacting with the fixing agent and being removed from the coating (which would be lost to the fixer bath). In particular, the coatings with compositions 50/15/35, 40/15/45 and 10/10/80 lose little, if any silver, and absorb significant amounts of iodide. This concentration of iodide ion may be found in fixer baths which are subjected to extensive electrolytic desilvering and low replenishment rates. Thus, the ability of the iodide-absorbing medium to absorb iodide from a solution containing thiosulfate or a fixing agent has been improved. The coatings containing the polymer layers and the Alkanol® XC overcoat enable iodide to be trapped, but do not allow thiosulfate to react with or remove the iodide-absorbing medium.

Examples 13, 17 and 21 show that significant amounts of iodide can be absorbed from a working-strength fixer bath containing iodide at a concentration of 0.005M without removing large quantities of iodide-absorbing silver from the coating. This concentration of iodide ion is typical of seasoned photographic fixer baths which are not electrolytically desilvered.

Several polymer compositions have been tested in the processing sequence described above with Fixer Bath 1 to assess the range of useful compositions that effect the removal of iodide from the fixer bath without significant reaction with thiosulfate during the process. An optimum polymer-surfactant combination would permit minimal reaction with thiosulfate when processed with the fixer baths.

The ionic polymers used in the invention can vary considerably in composition. The amounts of hydrophobic vinyl monomer A, hydrophilic ionic vinyl monomer B, and substitute vinyl monomer D in the polymer can be varied so as to produce the desired iodide absorbing performance when combined with an ionic surfactant in a manner described in this invention. The amount of hydrophilic ionic vinyl monomer should preferably be between 0.1 and 30 mole percent, but the optimum amount will depend on the identity and amounts of the co-monomers A and D in the polymer. If B is present in too high an amount, the polymer will be too permeable, and the fixing agent will react with the iodide-absorbing medium, reducing selectivity and capacity for iodide removal. If less permeability is desired, the amount of B can be decreased and/or the amount of hydrophobic vinyl monomer A can be increased so as to decrease the polymer permeability toward fixing agent, and improve the iodide-absorbing performance of the system. Depending on the desired contact time with the fixer bath, and upon the type of hydrophobic vinyl monomer A used in the polymer, we have found the useful amount of hydrophilic ionic vinyl monomer B to range from about 20 mole percent to about 2 mole percent, as will be shown in the Examples provided.

Polymer-surfactant combinations can be selected to control iodide absorption from fixer baths at different rates, and to be useful at longer contact times with the seasoned fixer bath. Coatings were subjected to the following process:

| | |
|---|---|
| Tap Water Presoak | 10.25 min. |
| Fixer Bath | 4.00 min. |
| Tap Water Wash | 3.00 min. |
| E-6 Stabilizer | 1.00 min. |

The E-6 stabilizer contains in 1 liter of aqueous solution:

| | |
|---|---|
| Formaldehyde (37% solution) | 6.5 g |
| Polyoxethylene 12 tridecyl alcohol | 0.14 g |

The use of a tap water wash and E-6 stabilizer are optional and have essentially no effect on the iodide absorption of the coating. The E-6 stabilizer was used in these examples because the wetting agent in the stabilizer helped the coatings dry more uniformly.

After drying, the silver and iodide contents of the coatings were determined by x-ray fluorescence. The results of a longer contact time with the fixer baths 1, 2, and 3 are shown in Table 3. Coatings 7 and 8 absorb iodide better in a one-minute contact with fixer bath (see Table 2 results). The less permeable coatings 5 and 6 are better in a four-minute contact with fixer bath. Longer contact times with fixer bath, if desired, will require less permeable polymer layers. Less permeability is expected to result by making the polymer more hydrophobic. This can be accomplished by (1) using a more hydrophobic vinyl monomer A in the polymer formulation, (2) using a higher mole percentage of hydrophobic vinyl monomer A in the polymer formulation, (3) using a less hydrophilic ionic vinyl monomer B in the polymer formulation, (4) using a smaller mole percentage of hydrophilic ionic vinyl monomer B in the polymer formulation, or (5) some combination of options (1) to (4) above.

In addition, less permeability is expected to result by using more polymer per unit surface area (higher polymer coverage). Also, the amount and type of ionic surfactant can be adjusted to produce the desired degree of permeability.

TABLE 3

| Contents of Coatings Contacted With Fixer Baths for 4 Minutes | | | | |
|---|---|---|---|---|
| Example | Sample Coating (Inventive) | Fixer Bath | Silver | Iodide |
| 10 | 5 | none | 3.00 | 0.22 |
| 42 | 5 | 1 | 2.98 | 0.23 |
| 43 | 5 | 2 | 2.60 | 1.05 |
| 44 | 5 | 3 | 2.88 | 0.40 |
| 14 | 6 | none | 2.99 | 0.22 |
| 45 | 6 | 1 | 3.00 | 0.23 |
| 46 | 6 | 2 | 2.21 | 1.94 |
| 47 | 6 | 3 | 2.73 | 0.58 |
| 18 | 7 | none | 2.33 | 0.17 |
| 48 | 7 | 1 | 1.96 | 0.16 |
| 49 | 7 | 2 | 2.12 | 2.38 |
| 50 | 7 | 3 | 1.14 | 1.28 |
| 22 | 8 | none | 2.22 | 0.15 |
| 51 | 8 | 1 | 0.19 | 0.05 |
| 52 | 8 | 2 | 1.58 | 1.77 |
| 53 | 8 | 3 | <0.01 | 0.01 |

quantities of each element are in $g/m^2$

The reaction between the iodide-absorbing medium and the fixing agent for some coatings in contact with the fixer bath can be lessened in some cases by presoaking the coatings in water prior to contacting them with the fixer bath (as done in Examples 1-53). Coatings were processed as follows (all solutions at 100° F.):

| | |
|---|---|
| Tap Water Presoak | 0, 10 or 30 min. |
| Fixer Bath 1 | 1, 4 or 12 min. |
| Tap Water Wash | 3.00 min. |
| E-6 Stabilizer | 1.00 min. |

After drying the coatings, the silver and iodide contents of them were determined by x-ray fluorescence. The results are listed in Table 4.

TABLE 4

| Contents of Presoaked and Non-presoaked Coatings Contacted With Fixer Bath 1 | | | | | |
|---|---|---|---|---|---|
| Example | Sample Coating (Inventive) | Presoak min. | Contact Time min. | Silver $g/m^2$ | Iodide $g/m^2$ |
| — | 5 | 0 | 0 | 3.00 | 0.22 |
| 54 | 5 | 0 | 1 | 0.47 | nd |
| 55 | 5 | 0 | 4 | 0 | nd |
| 56 | 5 | 0 | 12 | 0 | nd |
| 57 | 5 | 10 | 1 | 2.86 | nd |
| 58 | 5 | 10 | 4 | 2.86 | 0.23 |
| 59 | 5 | 10 | 12 | 2.98 | 0.23 |
| 60 | 5 | 30 | 1 | 3.00 | nd |
| 61 | 5 | 30 | 4 | 2.86 | 0.23 |
| 62 | 5 | 30 | 12 | 2.87 | 0.23 |
| — | 6 | 0 | 0 | 2.99 | 0.22 |
| 63 | 6 | 0 | 1 | 0.34 | nd |
| 64 | 6 | 0 | 4 | 0 | nd |
| 65 | 6 | 0 | 12 | 0 | nd |
| 66 | 6 | 10 | 1 | 2.88 | nd |
| 67 | 6 | 10 | 4 | 2.97 | 0.24 |
| 68 | 6 | 10 | 12 | 2.86 | 0.23 |
| 69 | 6 | 30 | 1 | 2.99 | nd |
| 70 | 6 | 30 | 4 | 2.91 | 0.23 |
| 71 | 6 | 30 | 12 | 2.97 | 0.24 |
| — | 7 | 0 | 0 | 2.97 | 0.17 |
| 72 | 7 | 0 | 1 | 1.96 | 0.17 |
| 73 | 7 | 0 | 4 | 1.93 | 0.17 |
| 74 | 7 | 0 | 12 | 1.45 | 0.18 |
| 75 | 7 | 10 | 1 | 1.99 | nd |
| 76 | 7 | 10 | 4 | 1.91 | 0.17 |
| 77 | 7 | 10 | 12 | 0.88 | 0.15 |
| 78 | 7 | 30 | 1 | 1.97 | nd |
| 79 | 7 | 30 | 4 | 1.82 | 0.16 |

TABLE 4-continued

| Contents of Presoaked and Non-presoaked Coatings Contacted With Fixer Bath 1 | | | | | |
|---|---|---|---|---|---|
| Example | Sample Coating (Inventive) | Presoak min. | Contact Time min. | Silver $g/m^2$ | Iodide $g/m^2$ |
| 80 | 7 | 30 | 12 | 0.97 | 0.14 |

nd = not determined

The results show that for coatings 5 and 6, the loss of silver from the coating to the fixer bath is significantly reduced if the coating is presoaked prior to being contacted with the fixer bath. This is not the case for coating 7, which loses less silver to the fixer bath if it is immersed into the bath in an initially dry state. It is not understood why presoaking lessens the reaction with fixing agent in some cases and not in others. The effect of presoaking may be assessed for each polymer-surfactant combination to see if improvements in performance result.

The presoaking and drying of a coating can be used to render it useful when it is introduced subsequently, in a dry condition, into fixer baths. (A more convenient use of these iodide-absorbing materials may be to introduce them into fixer baths in an initially dry condition.) Selected coatings were subjected to the following treatment and process (all solutions at 100° F.):

| | |
|---|---|
| Tap Water Presoak | 10.00 min. |
| Dry | 100-125° F. 45 min., Room Temp. 18 hr. |
| Fixer Bath 1 | 1, 4, 12 or 30 min. |
| Tap Water Wash | 3.00 min. |
| E-6 Stabilizer | 1.00 min. |

After drying, the silver and iodide contents of the coatings were determined by x-ray fluorescence. Analytical results are shown in Table 5.

TABLE 5

| Presoaked/Dried Coatings Contacted With Fixer Bath 1 | | | | | |
|---|---|---|---|---|---|
| Example | Sample Coating (Inventive) | Presoak min. | Contact Time min. | Silver $g/m^2$ | Iodide $g/m^2$ |
| — | 5 | 0 | 0 | 3.00 | 0.22 |
| 81 | 5 | 10 | 1 | 2.98 | nd |
| 82 | 5 | 10 | 4 | 2.96 | 0.24 |
| 83 | 5 | 10 | 12 | 2.88 | nd |
| 84 | 5 | 10 | 30 | 2.92 | nd |
| — | 6 | 0 | 0 | 2.99 | 0.22 |
| 85 | 6 | 10 | 1 | 3.01 | 0.23 |
| 86 | 6 | 10 | 4 | 2.88 | 0.21 |
| 87 | 6 | 10 | 12 | 2.95 | nd |
| — | 7 | 0 | 0 | 2.33 | 0.17 |
| 88 | 7 | 10 | 1 | 2.01 | 0.17 |
| 89 | 7 | 10 | 4 | 2.02 | nd |
| 90 | 7 | 10 | 12 | 1.19 | nd |
| 91 | 7 | 10 | 30 | 0.06 | nd |

nd = not determined

The presoaking and drying of coatings 5 and 6 result in virtually no reaction with fixing agent when these coatings are contacted with Fixer Bath 1 for several minutes (compare Examples 81-84 with Examples 54-56 and Examples 85-87 with Examples 63-65 in Table 4, in which coatings 5 and 6 were also dry when contacted with Fixer Bath 1, but not presoaked prior to contact with the fixer bath). As the results were coating 7 show, the presoaking and drying treatment is not effective for all polymers. The effect of presoaking and drying must be assessed for each polymer-surfactant combination to see if desired improvements result.

The utility of the coatings for the removal of iodide ion from the fixer baths is not impaired by the presoaking/drying treatment. Tables 6 and 7 give analytical data for the coatings in Table 5, substituting Fixer Bath 2 and Fixer Bath 3 for Fixer Bath 1 in the process sequence, respectively. When presoaked and then dried, the coatings exhibit very similar iodide absorption behavior compared to the behavior of the same coatings that are presoaked and then introduced into the fixer bath in the wet state.

TABLE 6

Presoaked/Dried Coatings Contacted With Fixer Bath 2

| Example | Sample Coating (Inventive) | Presoak min. | Contact Time min. | Silver g/m² | Iodide g/m² |
|---|---|---|---|---|---|
| — | 5 | 0 | 0 | 3.00 | 0.22 |
| 92 | 5 | 10 | 1 | 2.88 | 0.51 |
| 93 | 5 | 10 | 4 | 2.71 | 1.08 |
| 94 | 5 | 10 | 12 | 1.65 | nd |
| 95 | 5 | 10 | 30 | 1.63 | nd |
| — | 6 | 0 | 0 | 2.99 | 0.22 |
| 96 | 6 | 10 | 1 | 2.86 | 0.73 |
| 97 | 6 | 10 | 4 | 2.58 | 1.96 |
| 98 | 6 | 10 | 12 | 2.21 | nd |
| — | 7 | 0 | 0 | 2.33 | 0.17 |
| 99 | 7 | 10 | 1 | 2.20 | 2.51 |
| 100 | 7 | 10 | 4 | 1.99 | |
| 101 | | | | | |
| 101 | 7 | 10 | 12 | 1.82 | nd |
| 102 | 7 | 10 | 30 | 1.52 | nd |

nd = not determined

TABLE 7

Presoaked/Dried Coatings Contacted With Fixer Bath 3

| Example | Sample Coating (Inventive) | Presoak min. | Contact Time min. | Silver g/m² | Iodide g/m² |
|---|---|---|---|---|---|
| — | 5 | 0 | 0 | 3.00 | 0.22 |
| 103 | 5 | 10 | 1 | 3.00 | 0.27 |
| 104 | 5 | 10 | 4 | 2.85 | 0.36 |
| 105 | 5 | 10 | 12 | 1.38 | nd |
| 106 | 5 | 10 | 30 | 0.56 | nd |
| — | 6 | 0 | 0 | 3.00 | 0.22 |
| 107 | 6 | 10 | 1 | 3.01 | 0.32 |
| 108 | 6 | 10 | 4 | 2.78 | 0.56 |
| 109 | 6 | 10 | 12 | 0.80 | nd |
| — | 7 | 0 | 0 | 2.33 | 0.17 |
| 110 | 7 | 10 | 1 | 1.99 | 0.78 |
| 111 | 7 | 10 | 4 | 1.23 | nd |
| 112 | 7 | 10 | 12 | 0.98 | nd |
| 113 | 7 | 10 | 30 | 0.41 | nd |

nd = not determined

EXAMPLES 114–122

Multilayer coatings with the following structure on a fixer-impermeable support were prepared (Table 8). Coated quantities are in g/m² of material:

| | |
|---|---|
| Layer 3 | 1.08 gel + 0.16 surfactant + 0.09 BVSME |
| Layer 2 | 0.86 polymer + 0.03 10G + 0.02 Zonyl$^R$ FSN |
| Layer 1 | 3.23 AgBr + 0.14 10G + 3.23 gel |
| | 0.127 mm acetate support |

The first coated layer consisted of a conventionally prepared silver bromide octahedral emulsion (to serve as the iodide absorbing medium) with an average grain size of 0.4 micron diameter. It was coated in gelatin, using a nonionic surfactant, 10G, as a coating aid. The second layer consisted of the ionic polymer of the invention, using nonionic Surfactants, 10G and Zonyl ® FSN, as coating aids. Surfactant 10G is a nonionic surfactant supplied by Olin Corp., Stamford, Conn. It is a nonylphenoxypoly(glycidyl)glycidol, represented as:

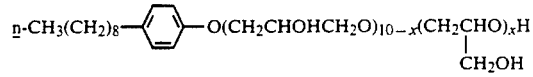

where x is between zero and ten. That is, there are approximately ten glycidyl units in the surfactant molecule, which can be 1,2- or 1,3-linked to each other.

Zonyl ® FSN is a nonionic surfactant manufactured by DuPont Co., Wilmington, Del. It is a fluorinated poly(ethylene oxide) surfactant, represented as:

$$F(CF_2CF_2)_x(CH_2CH_2O)_yH$$

where x is equal to or between 3 and 8 and y is equal to or between 9 and 13. The third layer consisted of gelatin, the ionic surfactant of the invention (which also serves as a coating aid), and a hardening agent, bis(-vinylsulfonylmethyl) ether (BVSME).

After coating and drying, these coatings were soaked in a tap water wash bath for 10 minutes at 75° F. and then dried again. These coatings were then placed in contact with efficiently agitated fixer baths followed by a tap water wash solution at 100° F. Two fixer baths (Nos. 4 and 5) contained bromide ion and iodide ion at concentrations resembling those that could be found with highly seasoned photographic fixer baths which are subject to electrolytic desilvering. Fixer bath 1 (see previous examples) contained no halide ions, only fixing agent. Fixer bath 4 contained a moderate level of iodide (0.005M) in addition to 1M bromide ion. Fixer bath 5 contained a higher level of iodide (0.05M) and 1M bromide. The compositions of the fixer baths were (per liter of solution):

| Fixer Bath 1 | |
|---|---|
| Ammonium Thiosulfate solution (56.5% ammonium thiosulfate, 4% ammonium sulfite [wt]) | 162 ml. |
| Sodium Metabisulfite | 11.85 g. |
| Sodium Hydroxide (50% solution) to adjust pH to 6.5 | 2 ml. (approx.) |

TABLE 8

| Coating | Polymer[a] | Surfactant [b] | AgBr, g/m² Ag |
|---|---|---|---|
| 17 (control) | gelatin | c | 3.33 |
| 18 (control) | A/B/C 50/15/35 | c | 3.35 |
| 19 (control) | D/E 97/3 | c | 3.35 |
| 20 (control) | gelatin | I-1 | 3.08 |
| 21 (control) | gelatin | I-6 + 1-7, (I-7/I-6 = .95) | 3.05 |
| 22 (inventive) | A/B/C 50/15/35 | I-1 | 3.08 |
| 23 (inventive) | D/E 97/3 | I-6 + 1-7, (I-7/I-6 = .95) | 3.08 |

[a]A = n-butyl methacrylate
B = 2-aminoethyl methacrylate, hydrochloride
C = 2-hydroxyethyl methacrylate
D = N-isopropylacrylamide
E = N-(3-aminopropyl)methacrylamide hydrochloride
Monomer composition is given in weight percent.
[b]I-1, (aerosol$^R$ OT, manufactured by American Cyanamide, Wayne, NJ)
I-6 + 1-7, (Alkanol$^R$ XC, manufactured by DuPont Co., Wilmington, DE)
[c]Nonionic surfactant 10G, obtained from Olin Corp., Stamford, CT, was used at 0.05 g/m²

| | |
|---|---|
| Fixer Bath 4 | |
| Ammonium Thiosulfate solution (56.5% ammonium thiosulfate, 4% ammonium sulfite [wt]) | 162 ml. |
| Sodium Metabisulfite | 11.85 g. |
| Ammonium Bromide (1M) | 98.0 g. |
| Ammonium Iodide (0.005M) | 0.725 g. |
| Sodium Hydroxide (50% solution), to adjust pH to 6.5 | 2 ml. (approx.) |
| Fixer Bath 5 | |
| Ammonium Thiosulfate solution (56.5% ammonium thiosulfate, 4% ammonium sulfite [wt]) | 162 ml. |
| Sodium Metabisulfite | 11.85 g. |
| Ammonium Bromide (1M) | 98.0 g. |
| Ammonium Iodide (0.05M) | 7.25 g. |
| Sodium Hydroxide (50% solution), to adjust pH to 6.5 | 2 ml. (approx.) |

The following general process was used:

| Processing Solution | Contact Time |
|---|---|
| Fixer Bath 1, 4, or 5 | Variable number of min. |
| Tap Water Wash | 4 min. |
| Dry | |

After drying, the silver and iodide contents of the coatings were measured by X-ray fluorescence (in g/m$^2$ of each element). The results are listed in Table 9.

TABLE 9

| Example | Coating | Fixer Contact Time, min. | Fixer Bath 1 Silver | Fixer Bath 1 Iodide | Fixer Bath 4 Silver | Fixer Bath 4 Iodide | Fixer Bath 5 Silver | Fixer Bath 5 Iodide |
|---|---|---|---|---|---|---|---|---|
| 114 | 17 control | 4 | 0 | — | 0 | 0 | 0.01 | 0.01 |
| 115 | 18 control | 4 | 0 | — | 0 | 0 | 0 | 0 |
| 116 | 19 control | 4 | 0 | — | 0 | 0 | 0.10 | 0.12 |
| 117 | 20 control | 4 | 0 | — | 0 | 0 | 0 | 0 |
| 118 | 21 control | 4 | 0 | — | 0 | 0 | 0 | 0 |
| 119 | 22 invention | 4 | 3.09 | — | 3.01 | 0.12 | 2.95 | 0.71 |
| 120 | 23 invention | 10 | 3.07 | — | 3.10 | 0.11 | 2.94 | 1.71 |
| 121 | 23 invention | 20 | 3.06 | — | | | 2.68 | 2.94 |
| 122 | 23 invention | 120 | 3.05 | — | 2.82 | 2.06 | | |

As can be seen from the Table 9 results, the comparative coatings which contain no combinations of ionic polymer and ionic surfactant in an overlying layer are ineffective in removing iodide from the fixer bath, and the iodide-absorbing material reacts completely with the fixing agent in only four minutes of contact with the fixer bath. The inventive combinations of ionic polymer and ionic surfactant in an overlying layer result in substantial iodide removal with little or no reaction of the iodide absorbing material with the fixing agent. Selectivity for iodide removal is substantially improved.

EXAMPLES 123–130

Multilayer coatings on a fixer-impermeable support with the same structure as the coatings of Examples 114–122 (ionic surfactant coated over the polymer layer) were prepared (Table 10). Coated quantities are in g/m$^2$ of material.

TABLE 10

| Coating | Polymer[a] | Surfactant [b] | AgBr g/m$^2$ Ag |
|---|---|---|---|
| 17 (control) | gelatin | c | 3.33 |
| 24 (control) | A/B/C 70/20/10 | c | 3.26 |
| 19 (control) | D/E 97/3 | c | 3.35 |
| 20 (control) | gelatin | I-1 | 3.08 |
| 21 (control) | gelatin | I-6 + I-7, (I-7/I-6 = .95) | 3.05 |
| 25 (inventive) | A/B/C 70/20/10 | I-1 | 3.08 |
| 23 (inventive) | D/E 97/3 | I-6 + I-7, (I-7/I-6 = .95) | 3.08 |

[a]A = n-butyl methacrylate
B = 2-aminoethyl methacrylate, hydrochloride
C = 2-hydroxyethyl methacrylate
D = N-isopropylacrylamide
E = N-(3-aminopropyl)methacrylamide hydrochloride
Monomer composition is given in weight percent.
[b]I-1, (Aerosol$^R$ OT, manufactured by American Cyanamide, Wayne, NJ)
I-6 + I-7, (Alkanol$^R$ XC, manufactured by DuPont Co., Wilmington, DE)
[c]Nonionic surfactant 10G, obtained from Olin Corp., Stamford, CT, was used at 0.05 g/m$^2$ After being coated and dried, these coatings were placed in contact with the efficiently agitated halide-containing Fixer Baths 1, 4, or 5 described in Example 114–122, above, followed by a tap water wash solution at 100° F., according to the following general process:

| Processing Solution | Contact Time |
|---|---|
| Fixer Bath 1, 4, or 5 | Variable number of min. |
| Tap Water Wash | 4 min. |
| Dry | |

After drying, the silver and iodide contents of the coatings were measured by X-ray fluorescence (in g/m$^2$ of each element). The results are listed in Table 11.

TABLE 11

| Example | Coating | Fixer Contact Time, min. | Fixer Bath 1 Silver | Fixer Bath 1 Iodide | Fixer Bath 4 Silver | Fixer Bath 4 Iodide | Fixer Bath 5 Silver | Fixer Bath 5 Iodide |
|---|---|---|---|---|---|---|---|---|
| 123 | 17 control | 4 | 0 | — | 0 | 0 | 0.01 | 0.01 |
| 124 | 24 control | 4 | 0 | — | 0 | 0 | 0.01 | 0.01 |
| 125 | 19 control | 4 | 0.01 | — | 0.01 | 0.01 | 0.12 | 0.14 |
| 126 | 20 control | 4 | 0 | — | 0 | 0 | 0 | 0 |
| 127 | 21 control | 4 | 0 | — | 0 | 0 | 0.01 | 0.01 |
| 128 | 25 invention | 10 | 2.98 | — | 2.95 | 0.09 | 2.80 | 0.42 |
| 129 | 23 invention | 10 | 3.10 | — | 3.10 | 0.09 | 2.56 | 1.91 |
| 130 | 23 invention | 120 | 3.07 | — | 2.72 | 2.13 | | |

As can be seen from the Table 11 results, the comparative coatings which contain no combinations of ionic polymer and ionic surfactant in an overlying layer are ineffective in removing iodide from the fixer bath, and the the iodide absorbing material reacts almost completely with the fixing agent in only four minutes of contact with the fixer bath. The inventive combinations of ionic polymer and ionic surfactant in an overlying layer result in substantial iodide removal with little or no reaction of the iodide absorbing material with the fixing agent. These iodide-absorbing materials can be used after they have been coated and dried, without any additional wetting and drying.

EXAMPLES 131-136

Multilayer coatings with the following structure on a fixer-impermeable support were prepared (Table 12). Coated quantities are in g/m$^2$ of material:

| | |
|---|---|
| Layer 3 | 1.08 gel + 0.08 surfactant 10G + 0.09 BVSME |
| Layer 2 | 0.86 polymer + 0.03 10G + 0.02 Zonyl$^R$ FSN |
| Layer 1 | 3.23 AgBr + 0.16 Surfactant + 3.23 gel |
| | 0.127 mm acetate support |

The first coated layer consisted of a conventionally prepared silver bromide octahedral emulsion (to serve as the iodide exchange medium) with an average grain size of 0.4 micron diameter. It was coated in gelatin with the ionic surfactant of the invention, which also serves as a coating aid. The second layer consisted of the ionic polymer of the invention, using nonionic surfactants, 10G and Zonyl ® FSN, as coating aids. Refer to Examples 114-122 for a description of these nonionic surfactants. The third layer consisted of gelatin, a nonionic surfactant, 10G (which serves as a coating aid), and a hardening agent, bis(vinylsulfonylmethyl) ether (BVSME).

These coatings were placed in contact with the efficiently agitated Fixer Baths 1, 4, or 5 described in Examples 114-122, above, followed by a tap water wash (all solutions at 100° F.), according to the following general process:

| Processing Solution | Contact Time |
|---|---|
| Fixer Bath 1, 4, or 5 | Variable number of min. |
| Tap Water Wash | 4 min. |
| Dry | |

After drying, the silver and iodide contents of the coatings were measured by X-ray fluorescence (in g/m$^2$ of each element). The results are listed in Table 13.

As can be seen from the Table 13 results, the comparative coatings which contain no combinations of ionic polymer and ionic surfactant in an underlying layer are ineffective in removing iodide from the fixer bath, and the iodide-absorbing material reacts completely with the fixing agent in only four minutes of contact with the fixer bath. The inventive combinations of ionic polymer and ionic surfactant in an underlying layer result in substantial iodide removal with little or no reaction of the iodide absorbing material with the fixing agent. These iodide-absorbing materials can be used after they have been coated and dried, without any additional wetting and drying.

TABLE 12

| Coating | Polymer[a] | Surfactant[b] | AgBr, g/m$^2$ Ag |
|---|---|---|---|
| 26 (control) | gelatin | c | 3.06 |
| 27 (control) | A/B/C 50/15/35 | c | 3.06 |
| 28 (control) | A/B/C 70/20/10 | c | 3.06 |
| 29 (control) | gelatin | I-1 | 3.26 |
| 30 (inventive) | A/B/C 50/15/35 | I-1 | 3.26 |
| 31 (inven-) tive | A/B/C 70/20/10 | I-1 | 3.26 |

[a]A = n-butyl methacrylate
B = 2-aminoethyl methacrylate, hydrochloride
C = 2-hydroxyethyl methacrylate
Monomer composition is given in weight percent.
[b]I-1, (Aerosol$^R$ OT, manufactured by American Cyanamide, Wayne, NJ)
[c]Nonionic surfactant 10G, obtained from Olin Corp., Stamford, CT, was used at 0.14 g/m$^2$

TABLE 13

| Example | Coating | Fixer Contact Time, min. | Fixer Bath 1 Silver | Fixer Bath 1 Iodide | Fixer Bath 4 Silver | Fixer Bath 4 Iodide | Fixer Bath 5 Silver | Fixer Bath 5 Iodide |
|---|---|---|---|---|---|---|---|---|
| 131 | 26 control | 4 | 0 | — | 0 | 0 | 0 | 0 |
| 132 | 27 control | 4 | 0 | — | 0 | 0 | 0 | 0 |
| 133 | 28 control | 4 | 0 | — | 0 | 0 | 0.01 | 0.01 |
| 134 | 29 control | 4 | 0 | — | 0 | 0 | 0 | 0 |
| 135 | 30 invention | 10 | 3.23 | — | 3.26 | 0.15 | 2.86 | 0.98 |
| 136 | 31 invention | 60 | 3.23 | — | 3.30 | 0.04 | 3.00 | 0.37 |

EXAMPLE 137-149

Multilayer coatings on a fixer-impermeable support with the same structure as the coatings of Examples 131-136 (ionic surfactant present in AgBr layer) were prepared (Table 14). Coated quantities are in g/m$^2$ of material.

After being coated and dried, these coatings were soaked in 75° F. tap water for 10 min. and dried. After this treatment, they were placed in contact with the efficiently agitated halide-containing Fixer Baths 1, 4, and 5 described in Examples 114-122, above, followed by a tap water wash solution at 100° F., according to the following general process:

| Processing Solution | Contact Time |
|---|---|
| Fixer Bath 1, 4, or 5 | Variable number of min. |
| Tap Water Wash | 4 min. |
| Dry | |

After drying, the silver and iodide contents of the coatings were measured by X-ray fluorescence (in g/m$^2$ of each element). The results are listed in Table 15.

As can be seen from the Table 15 results, the comparative coatings which contain no combinations of ionic polymer and ionic surfactant in an underlying layer are ineffective in removing iodide from the fixer bath, and the iodide-absorbing material reacts completely with the fixing agent in only four minutes of contact with the fixer bath. The inventive combinations of ionic polymer and ionic surfactant in an underlying layer result in substantial iodide removal with little or no reaction of the iodide-absorbing material with the fixing agent. By presoaking and drying the coatings, several polymer-surfactant combinations can be effective in removing iodide from seasoned fixer baths.

TABLE 14

| Coating | Polymer[a] | Surfactant[b] | AgBr, g/m² Ag |
|---|---|---|---|
| 26 (control | gelatin | c | 3.06 |
| 27 (control) | A/B/C 50/15/35 | c | 3.06 |
| 28 (control) | A/B/C 70/20/10 | c | 3.06 |
| 32 (control) | D/E 97/3 | I-1 | 3.00 |
| 29 (control) | gelatin | I-1 | 3.26 |
| 33 (control) | gelatin | I-6 + I-7, (I-7/I-6 = .95) | 3.11 |
| 34 (control) | gelatin | I-9 | 3.14 |
| 30 (inventive) | A/B/C 50/15/35 | I-1 | 3.26 |
| 35 (inventive) | A/B/C 70/20/10 | I-9 | 3.21 |
| 31 (inventive) | A/B/C 70/20/10 | I-1 | 3.26 |
| 36 (inventive) | A/B/C 70/20/10 | I-6 + I-7, (I-7/I-6 = .95) | 3.17 |
| 37 (inventive) | A/B/C 70/20/10 | I-9 | 3.18 |
| 38 (inventive) | DE 97/3 | I-1 | 3.28 |

[a]A = n-butyl methacrylate
B = 2-aminoethyl methacrylate, hydrochloride
C = 2-hydroxyethyl methacrylate
D = N-isopropylacrylamide
E = N-(3-aminopropyl)methacrylamide hydrochloride
Monomer composition is given in weight percent.
[b]I-1, (Aerosol[R] OT, manufactured by American Cyanamide, Wayne, NJ)
I-6 + I-7, (Alkanol[R] XC, manufactured by DuPont Co., Wilmington, DE)
[c]Nonionic surfactant 10G, obtained from Olin Corp., Stamford, CT, was used at 0.14 g/m²

TABLE 15

| Example | Coating | Fixer Contact Time, min. | Fixer Bath 1 Silver | Fixer Bath 1 Iodide | Fixer Bath 4 Silver | Fixer Bath 4 Iodide | Fixer Bath 5 Silver | Fixer Bath 5 Iodide |
|---|---|---|---|---|---|---|---|---|
| 137 | 26 control | 4 | 0 | — | 0 | 0 | 0 | 0 |
| 138 | 27 control | 4 | 0 | — | 0 | 0 | 0 | 0 |
| 139 | 28 control | 4 | 0 | — | 0 | 0 | 0.01 | 0.01 |
| 140 | 32 control | 4 | 0 | — | 0 | 0 | 0 | 0 |
| 141 | 29 control | 4 | 0 | — | 0 | 0 | 0 | 0 |
| 142 | 33 control | 4 | 0 | — | 0 | 0. | 0 | 0 |
| 143 | 34 control | 4 | 0 | — | 0 | 0 | 0 | 0 |
| 144 | 30 inventive | 4 | 3.22 | — | 3.37 | 0.13 | 2.85 | 0.98 |
| 145 | 35 inventive | 4 | 3.19 | — | 3.29 | 0.05 | 3.12 | 0.38 |
| 146 | 31 inventive | 60 | 3.23 | — | 3.34 | 0.02 | 3.27 | 0.27 |
| 147 | 36 inventive | 60 | 3.15 | — | 3.32 | 0.03 | 3.09 | 0.28 |
| 148 | 37 inventive | 20 | 3.07 | — | 3.25 | 0.09 | 2.97 | 0.52 |
| 149 | 38 inventive | 4 | 3.12 | — | 3.32 | 0.06 | 2.86 | 0.72 |

The invention has been described in detail with particular reference to preferred embodiments thereof, but it will be understood that variations and modifications can be effected within the spirit and scope of the invention.

We claim:

1. A method or removing iodide ion from an aqueous photographic processing solution with a fixing ability, said solution comprising a thiosulfate as a fixing agent, comprising placing in contact with said solution a composite article comprising a surfactant, an iodide absorbing medium, and a polymer that is permeable to iodide ion overlaying said iodide absorbing medium.

2. The method of claim 1 wherein said composite article further comprises a fixer impermeable substrate carrying said iodide absorbing medium.

3. The method of claim 2 wherein said article comprises a strip and said strip is contacted with said solution at a rate so as to allow the removal of iodide ions.

4. The method of claim 1 wherein said iodide absorbing medium comprises at least one member of the group consisting of silver bromide, silver chloride, silver bromoiodide, and silver chlorobromide, silver chloroiodide, silver chlorobromoiodide, and silver thiocyanate.

5. The method of claim 1 wherein said polymer is cationic and said surfactant is anionic, or said polymer is anionic and said surfactant is cationic.

6. The method of claim 5 wherein said surfactant comprises at least one member selected from the group consisting of $$R_1O_{n-1}SO_3M \quad \text{I.}$$

$$R_1CO_2M \quad \text{II.}$$

$$R_1OP(O)(OM)_2 \quad \text{III.}$$

$$R_1OP(O)OR_2OM \quad \text{IV.}$$

wherein n represents 1 or 2;

M represents a cation;

$R_1$ represents a hydrophobic group having 6 to 40 carbons;

$R_2$ represents $R_1$ or an organic group having 1 to 5 carbon atoms.

7. The method of claim 6 wherein M represents an alkali metal atom or an ammonium group.

8. The method of claim 5 wherein said surfactant comprises at least one of alkane sulfonates,
alcohol sulfates (alkylsulfuric acid esters),
ether alcohol sulfates,
sulfated polyol esters,
sulfated alkanolamides,
sulfated amides,
sulfated esters,
sulfonated esters,
alkylated arylsulfonates,
olefin sulfonates,
sulfopolycarboxylic esters,
sulfoalkylesters of fatty acids,
sulfoalkylamides of fatty acids,
sulfated monoglycerides,
sulfated fat or oil with a free carboxyl group, and
α-sulfocarboxylic acids.

9. The method of claim 5 wherein said surfactant comprises at least one of $$\begin{array}{l} \quad\;\; CH_2COOCH_2CH(C_2H_5)C_4H_9 \\ \quad\;\; | \\ NaO_3SCHCOOCH_2CH(C_2H_5)C_4H_9 \end{array}$$

$$\begin{array}{l} \quad\;\; CH_2COOCH(CH_3)C_4H_9 \\ \quad\;\; | \\ NaO_3SCHCOOCH(CH_3)C_4H_9 \end{array}$$

$$\underline{n}\text{-}C_{12}H_{25}OSO_3Na$$

-continued $\underline{n}$-$C_{16}H_{33}SO_3Na$

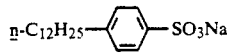

sodium tri-isopropylnaphthalenesulfonate
sodium di-isopropylnaphthalenesulfonate

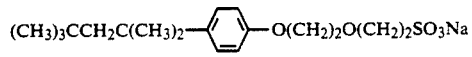

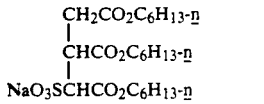

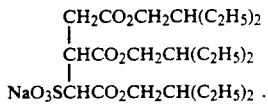

10. The method of claim 5 wherein said surfactant comprises at least one of alkali metal or ammonium salts of fatty acids, and alkali metal or ammonium salts of alkylphenoxypoly(ethyleneoxy)acetic acids.

11. The method of claim 5 wherein said surfactant comprises at least one of alkoxypoly(ethyleneoxy)ethyl phosphates, alkylphenoxypoly(ethyleneoxy)ethyl phosphates, and bis(alkoxypoly(ethyleneoxy)ethyl) phosphates.

12. The method of claim 1 wherein said polymer comprises a copolymer comprising at least one nonionic and at least one ionic monomer.

13. The method of claim 12 wherein said polymer comprises at least one of butyl methacrylate-co-2-aminoethyl methacrylate hydrochloride-co-2-hydroxyethyl methacrylate, and N-isopropylacrylamide-co-N-(3-aminopropyl)methacrylamide hydrochloride.

14. The method of claim 12 wherein said polymer permeable to iodide ion comprises at least one polymer represented by the general Formula I:

$$-(A)_x-(B)_y-(D)_z \quad (1)$$

wherein x designates 0 to 99.9 mole percent, y designates 0.1 to 30 mole percent, z designates 0 to 99.9 mole percent, and $x+y+z=100$ mole percent, wherein (A) represents recurring units derived form one or more nonionic hydrophobic vinyl monomers of the general Formula 2:

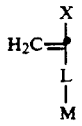

(2)

wherein

X=H, $CH_3$

L=a single bond

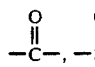

$-SO_2-$, $-SO_3-$, $-O-$,

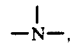

Arylene, Alkylene,

—C=N—, —S—, nitrilo, and heterocyclyl containing one or more N, O, S; combination of these groups, and combinations of the above groups described as L with alkylene chains;

M=—OR, —SR, —NHR, $-NR_1R_2$, —R,

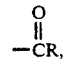

wherein R, $R_1$, and $R_2$ represent:

(a) straight-chain or branched-chain alkyl substituents having 1 to 15 carbons, (b) arylene substituents, (c) heterocyclic substituents containing one or more N, S, O, (d) any of the groups described in (a) through (c) above having one or more sites of unsaturation, (e) any of the groups described in (a) through (d) above in which hydrogen is substituted with one or more fluorine, chlorine, bromine, iodine, alkoxy, acyloxy, alkylsulfoxy, alkylsulfonyl, nitro, thio, keto, or nitrile groups, and (f) combinations of the groups described in (a) through (e) above;

wherein B in general Formula I represents recurring units of one or more hydrophilic ionic vinyl monomers of the general Formula 3, wherein X and L represent groups listed above under Formula 2,

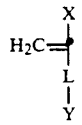

(3)

and wherein:

Y=an ionic group including heterocyclic ionic groups such as imidazolium, thiazolium, pyridinium, as well as ionic groups such as $-NH_3^+$, $-NH_2R^+$, $-NHR_1R_2^+$, $-NR_1R_2R_3^+$, $=NR_1R_2^+$, $-CO_2^-$, $-SO_2^-$, $-SO_3^-$, $-O^-$, $-OPO_3^{-2}$ and $-SR_2^+$, wherein R, $R_1$, $R_2$, $R_3$=straight- or branched-chain alkyl of 1 to 10 carbons, and associated counterions of these ionic groups wherein D may represent either:

(a) one or more hydrophilic ionic monomers of Formula 3 having the same or opposite charge as B in Formula 1, or one or more hydrophilic nonionic vinyl monomers not represented by Formula 3, wherein the nonionic hydrophilic vinyl monomer may comprise up to 99.9 mole percent, as long as the ionic content represented by B is present in at least 0.1 mole percent, and ionic or nonionic hydrophilic vinyl monomer D can be selected from virtually any class of vinyl monomer capable of undergoing free radical polymerization; if D is ionic, then (y+z) of Formula 1 is less than or equal to about 30 mole percent;

(b) one or more hydrophobic nonionic vinyl monomers represented by general Formula 2 or one or more hydrophobic nonionic vinyl monomers not represented by Formula 2, to an extent generally less than 50 mole percent wherein D may be selected from any class of vinyl monomer capable of undergoing free radical polymerization, derived from any other vinyl monomer used to make the polymer either by subsequent chemical modification of the polymer or by pH induced change in ionization to give an uncharged rather than ionic form; the hydrophobic monomer D may be one that is either insoluble in water, or forms homopolymers that are insoluble in water, or forms homopolymers that exhibit inverse temperature solubility properties (precipitate on heating in solution).

15. The method of claim 14 wherein B comprises at least one of vinyl ketones, N-vinyl amides, N-vinyl lactams, vinyl imidazoles, vinyl pyridines, vinyl sulfones, vinyl ethers, vinyl esters, vinyl urylenes, vinyl urethanes, vinyl nitriles, vinyl anhydrides, vinyl imines, vinyl imides, vinyl halides, vinyl aldehydes, styrenes and substituted styrenes, vinyl naphthalenes, vinyl heterocycles containing oxygen, nitrogen, or sulfur and combinations of these heteroatoms, acrylamides, methacrylamides, acrylates, and methacrylates.

16. The method of claim 14 wherein B comprises at least one monomer selected from the group consisting of sodium acrylate, 2-aminoethyl acrylate hydrochloride, 2-aminoethyl methacrylate hydrochloride, N-(3-aminopropyl)methacrylamide hydrochloride, p-styrenesulfonic acid sodium salt, N-(3-dimethylaminopropyl)methacrylamide hydrochloride, 2-aminoethyl vinyl ether hydrochloride, 2-aminoethyl styryl ether hydrochloride, 4-vinylpyridine hydrochloride, 2-vinylpyridine hydrochloride, N-vinylimidazole hydrochloride, N-alkyl-2-vinylimidazole hydrochlorides, N-alkyl-4-vinylimidazole hydrochlorides, N-alkyl-5-vinylimidazole hydrochlorides, and N-(2-sulfo-1,1-dimethylethyl)acrylamide sodium salt.

17. The method of claim 14 wherein D comprises at least one of acrylamide, N-methylacrylamide, N,N-dimethylacrylamide, 2-hydroxyethyl acrylate, 2-hydroxyethyl methacrylate, 2-hydroxypropyl acrylate, 2-hydroxypropyl methacrylate, N-(2-hydroxyethyl)methacrylamide, N-(2-hydroxyethyl)acrylamide, and N-(2-hydroxypropyl)methacrylamide.

18. The method of claim 14 wherein A comprises at least one of butyl acrylate, butyl methacrylate, styrene and substituted styrenes, N-t-butylacrylamide, N-t-butylmethacrylamide, N-isopropylacrylamide, and N-isopropylmethacrylamide.

19. The method of claim 1 wherein said surfactant is incorporated in said absorbing medium.

20. The method of claim 1 wherein said iodide absorbed medium is encapsulated by said polymer.

21. The method of claim 1 wherein said surfactant is between said polymer layer and said iodide absorbing medium.

22. The method of claim 1 wherein said surfactant overlays said iodide absorbing medium.

23. The method of claim 1 wherein the processing solution with a fixing ability is circulated so as to pass by said article.

24. An iodide removal article comprising a substrate, a layer of iodide absorbing medium upon the substrate, a layer of iodide ion permeable polymer overlaying said absorbing medium, and a surfactant in contact with said polymer.

25. The article of claim 24 wherein said surfactant is incorporated into a layer overlaying said polymer layer.

26. The article of claim 24 wherein said surfactant is incorporated into said iodide absorbing medium.

27. The article of claim 24 wherein said iodide absorbing medium comprises at least one of silver bromide, silver chloride, silver bromoiodide, silver chlorobromide, silver chloroiodide, silver chlorobromoiodide, and silver thiocyanate.

28. The article of claim 24 wherein said substrate is impermeable to fixer solution.

29. The article of claim 24 wherein said surfactant is located in a layer between said iodide absorbing medium and said polymer.

30. The article of claim 24 wherein said polymer is cationic and said surfactant is anionic, or said polymer is anionic and said surfactant is cationic.

31. The article of claim 24 wherein said polymer comprises at least one of butyl methacrylate-co-2-aminoethyl methacrylate hydrochloride-co-2-hydroxyethyl methacrylate, and N-isopropylacrylamide-co-N-(3-aminopropyl)methacrylamide hydrochloride.

32. The article of claim 24 wherein said polymer comprises a copolymer comprising at least one nonionic and at least one ionic monomer.

33. The article of claim 24 wherein said surfactant comprises at least one member selected from the group consisting of $$R_1O_{n-1}SO_3M \quad \text{I.}$$
$$R_1CO_2M \quad \text{II.}$$
$$R_1OP(O)(OM)_2 \quad \text{III.}$$
$$R_1OP(O)OR_2OM \quad \text{IV.}$$

wherein n represents 1 or 2;

M represents a cation;

$R_1$ represents a hydrophobic group having 6 to 40 carbons, $R_2$ represents $R_1$ or an organic group having 1 to 5 carbon atoms.

34. The article of claim 33 wherein M represents an alkali metal atom or an ammonium group.

35. The article of claim 24 wherein said surfactant comprises at least one of alkane sulfonates,
alcohol sulfates (alkylsulfuric acid esters),
ether alcohol sulfates,
sulfated polyol esters,
sulfated alkanolamides,
sulfated amides,
sulfated esters,
sulfonated esters,
alkylated arylsulfonates,
olefin sulfonates,
sulfopolycarboxylic esters,
sulfoalkylesters of fatty acids,
sulfoalkylamides of fatty acids,
sulfated monoglycerides,
sulfated fat or oil with a free carboxyl group, and
α-sulfocarboxylic acids.

36. The article of claim 24 wherein said surfactant comprises at least one of $$\begin{array}{l} CH_2COOCH_2CH(C_2H_5)C_4H_9 \\ | \\ NaO_3SCHCOOCH_2CH(C_2H_5)C_4H_9 \end{array}$$

$$\begin{array}{l} CH_2COOCH(CH_3)C_4H_9 \\ | \\ NaO_3SCHCOOCH(CH_3)C_4H_9 \end{array}$$

$\underline{n}$-$C_{12}H_{25}OSO_3Na$ $\underline{n}$-$C_{16}H_{33}SO_3Na$

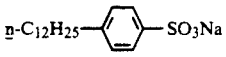

sodium tri-isopropylnaphthalenesulfonate
sodium di-isopropylnaphthalenesulfonate

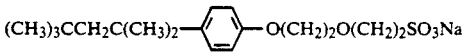

$$\begin{array}{l} CH_2CO_2C_6H_{13}\text{-}\underline{n} \\ | \\ CHCO_2C_6H_{13}\text{-}\underline{n} \\ | \\ NaO_3SCHCO_2C_6H_{13}\text{-}\underline{n} \end{array}$$

$$\begin{array}{l} CH_2CO_2CH_2CH(C_2H_5)_2 \\ | \\ CHCO_2CH_2CH(C_2H_5)_2 \\ | \\ NaO_3SCHCO_2CH_2CH(C_2H_5)_2 \end{array}$$

37. The article of claim 24 wherein said surfactant comprises at least one of alkali metal or ammonium salts or fatty acids, and alkali metal or ammonium salts of alkylphenoxypoly(ethyleneoxy)acetic acids.

38. The article of claim 24 wherein said surfactant comprises at least one of alkoxypoly(ethyleneoxy)ethyl phosphates, alkylphenoxypoly(ethyleneoxy)ethyl phosphates, and bis(alkoxypoly(ethyleneoxy)ethyl) phosphates.

39. The article of claim 24 wherein said polymer permeable to iodide ion comprises at least one polymer represented by the general Formula 1:

$$-(A)_x-(B)_y-(D)_z \qquad (1)$$

wherein x designates 0 to 99.9 mole percent, y designates 0.1 to 30 mole percent, z designates 0 to 99.9 mole percent, and $x+y+z=100$ mole percent, wherein (A) represents recurring units derived from one or more nonionic hydrophibic vinyl monomers of the general Formula 2:

$$\begin{array}{l} \quad\;\; X \\ \quad\;\; | \\ H_2C{=}\bullet \\ \quad\;\; | \\ \quad\;\; L \\ \quad\;\; | \\ \quad\;\; M \end{array} \qquad (2)$$

wherein

X=H, $CH_3$

L=a single bond, $$\overset{O}{\overset{\|}{-C-}},\ \overset{O}{\overset{\|}{-S-}},$$

$-SO_2-$, $-SO_3-$, $-O-$, $$\overset{|}{-N-},$$

Arylene, Alkylene,

—C=N—, —S—, nitrilo, and heterocyclyl containing one or more N, O, S; combination of these groups;

and combinations of the above groups described as L with alkylene chains;

M=—OR, —SR, —NHR, $-NR_1R_2$, —R, $$\overset{O}{\overset{\|}{-CR}},$$

wherein R, $R_1$, and $R_2$ represent:

(a) straight-chain or branched-chain alkyl substituents having 1 to 15 carbons, (b) arylene substituents, (c) heterocyclic substituents containing one or more N, S, O, (d) any of the groups described in (a) through (c) above having one or more sites of unsaturation, (e) any of the groups described in (a) through (d) above in which hydrogen is substituted with one or more fluorine, chlorine, bromine, iodine, alkoxy, acyloxy, alkylsulfoxy, alkylsulfonyl, nitro, thio, keto, or nitrile groups, and (f) combinations of the groups described in (a) through (e) above;

wherein B in general Formula 1 represents recurring units of one or more hydrophilic ionic vinyl monomers of the general Formula 3, wherein X and L represent groups listed above under Formula 2, $$\begin{array}{l} \quad\;\; X \\ \quad\;\; | \\ H_2C{=}\bullet \\ \quad\;\; | \\ \quad\;\; L \\ \quad\;\; | \\ \quad\;\; Y \end{array} \qquad (3)$$

and wherein:

Y=an ionic group including heterocyclic ionic groups such as imidazolium, thiazolium, pyridinium, as well as ionic groups such as $-NH_3^+$, $-NH_2R^+$, $-NHR_1R_2^+$, $-NR_1R_2R_3^+$, $=NR_1R_2^+$, $-CO_2^-$, $-SO_2^-$, $-SO_3^-$, $-O^-$, $-OPO_3^{-2}$ and $-SR_2^+$, wherein R, $R_1$, $R_2$, $R_3$=straight- or branched-chain alkyl of 1 to 10 carbons, and associated counterions of these ionic groups wherein D may represent either:

(a) one or more hydrophilic ionic monomers of Formula 3 having the same or opposite charge as B in Formula 1, or one or more hydrophilic nonionic vinyl monomers not represented by Formula 3, wherein the nonionic hydrophilic vinyl monomer may comprise up to 99.9 mole percent, as long as the ionic content represented by B is present in at least 0.1 mole percent, and ionic or nonionic hydrophilic vinyl monomer D can be selected from virtually any class of vinyl monomer capable of undergoing free radical polymerization; if D is ionic, then (y+z) of Formula 1 is less than or equal to about 30 mole percent;

(b) one or more hydrophobic nonionic vinyl monomers represented by general Formula 2 or one or more hydrophobic nonionic vinyl monomers not represented by Formula 2, to an extent generally less than 50 mole percent wherein D may be selected from any class of vinyl monomer capable of undergoing free radical polymerization, derived from any other vinyl monomer used to make the polymer either by subsequent chemical modification of the polymer or by pH induced change in ionization to give an uncharged rather than ionic form; the hydrophobic monomer D may be one that is either insoluble in water, or forms homopolymers that are insoluble in water, or forms homopolymers that exhibit inverse temperature solubility properties (precipitate on heating in solution).

40. The article of claim 39 wherein B comprises at least one of vinyl ketones, N-vinyl amides, N-vinyl lactams, vinyl imidazoles, vinyl pyridines, vinyl sulfones, vinyl ethers, vinyl esters, vinyl urylenes, vinyl urethanes, vinyl nitriles, vinyl anhydrides, vinyl imines, vinyl imides, vinyl halides, vinyl aldehydes, styrenes and substituted styrenes, vinyl naphthalenes, vinyl heterocycles containing oxygen, nitrogen, or sulfur and combinations of these heteroatoms, acrylamides, methacrylamides, acrylates, and methacrylates.

41. The article of claim 39 wherein B comprises at least one monomer selected from the group consisting of sodium acrylate, 2-aminoethyl acrylate hydrochloride, 2-aminoethyl methacrylate hydrochloride, N-(3-amino-propyl)methacrylamide hydrochloride, p-styrenesulfonic acid sodium salt, N-(3-dimethylamino-propyl)methacrylamide hydrochloride, 2-aminoethyl vinyl ether hydrochloride, 2-aminoethyl styryl ether hydrochloride, 4-vinylpyridine hydrochloride, 2-vinylpyridine hydrochloride, N-vinyl-imidazole hydrochloride, N-alkyl-2-vinylimidazole hydro-chlorides, N-alkyl-4-vinylimidazole hydrochlorides, N-alkyl-5-vinylimidazole hydrochlorides, and N-(2-sulfo-1,1-dimethylethyl)acrylamide sodium salt.

42. The article of claim 39 wherein D comprises at least one of acrylamide, N-methylacrylamide, N,N-dimethylacrylamide, 2-hydroxyethyl acrylate, 2-hydroxyethyl methacrylate, 2-hydroxypropyl acrylate, 2-hydroxypropyl methacrylate, N-(2-hydroxyethyl)methacrylamide, N-(2-hydroxyethyl)acrylamide, and N-(2-hydroxypropyl)methacrylamide.

43. The article of claim 39 wherein A comprises at least one of butyl acrylate, butyl methacrylate, styrene and substituted styrenes, N-t-butylacrylamide, N-t-butylmethacrylamide, N-isopropylacrylamide, and N-isopropylmethacrylamide.

44. An iodide absorbing article comprising an iodide absorbing medium encapsulated by a iodide ion permeable polymer and a surfactant in contact with said polymer.

45. The article of claim 44 wherein said iodide absorbing medium comprises at least one of silver bromide, silver chloride, silver bromoiodide, silver chlorobromide, silver chloroiodide, silver chlorobromoiodide, and silver thiocyanate.

46. The article of claim 44 wherein said surfactant is incorporated into a layer overlaying said polymer layer.

47. The article of claim 44 wherein said surfactant is located in a layer between said iodide absorbing medium and said polymer.

48. The article of claim 44 wherein said polymer is cationic and said surfactant is anionic, or said polymer is anionic and said surfactant is cationic.

49. The article of claim 44 wherein said surfactant is incorporated into said iodide absorbing medium.

50. The article of claim 44 wherein said surfactant comprises at least one member selected from the group consisting of $R_1O_{n-1}SO_3M$ I.
$R_1CO_2M$ II.
$R_1OP(O)(OM)_2$ III.
$R_1OP(O)OR_2OM$ IV.

wherein n represents 1 or 2;

M represents a cation;

$R_1$ represents a hydrophobic group having 6 to 40 carbons;

$R_2$ represents $R_1$ or an organic group having 1 to 5 carbon atoms.

51. The article of claim 50 wherein M represents an alkali metal atom or an ammonium group.

52. The article of claim 44 wherein said surfactant comprises at least one of alkane sulfonates,
alcohol sulfates (alkylsulfuric acid esters),
ether alcohol sulfates,
sulfated polyol esters,
sulfated alkanolamides,
sulfated amides,
sulfated esters,
sulfonated esters,
alkylated arylsulfonates,
olefin sulfonates,
sulfopolycarboxylic esters,
sulfoalkylesters of fatty acids,
sulfoalkylamides of fatty acids,
sulfated monoglycerides,
sulfated fat or oil with a free carboxyl group, and
α-sulfocarboxylic acids.

53. The article of claim 44 wherein said surfactant comprises at least one of

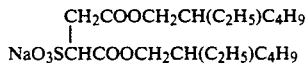

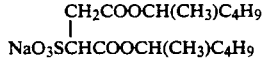

$n\text{-}C_{12}H_{25}OSO_3Na$ $n\text{-}C_{16}H_{33}SO_3Na$

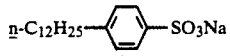

sodium tri-isopropylnaphthalenesulfonate
sodium di-isopropylnaphthalenesulfonate

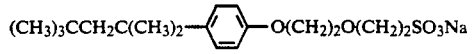

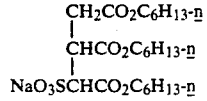

-continued $$\begin{array}{l} CH_2CO_2CH_2CH(C_2H_5)_2 \\ | \\ CHCO_2CH_2CH(C_2H_5)_2 \\ | \\ NaO_3SCHCO_2CH_2CH(C_2H_5)_2 \end{array}$$

54. The article of claim 44 wherein said surfactant comprises at least one of alkali metal or ammonium salts of fatty acids, and alkali metal or ammonium salts of alkylphenoxypoly(ethyleneoxy)acetic acids.

55. The article of claim 44 wherein said surfactant comprises at least one of alkoxypoly(ethyleneoxy)ethyl phosphates, alkylphenoxypoly(ethyleneoxy)ethyl phosphates, and bis(alkoxypoly(ethyleneoxy)ethyl) phosphates.

56. The article of claim 44 wherein said polymer comprises at least one polymer represented by the general Formula 1:

$$-(A)_x-(B)_y-(D)_z \quad (1)$$

wherein x designates 0 to 99.9 mole percent, y designates 0.1 to 30 mole percent, z designates 0 to 99.9 mole percent, and $x+y+z=100$ mole percent, wherein (A) represents recurring units derived from one or more nonionic hydrophobic vinyl monomers of the general Formula 2:

$$\begin{array}{l} \quad X \\ \quad | \\ H_2C= \\ \quad | \\ \quad L \\ \quad | \\ \quad M \end{array} \quad (2)$$

wherein

X=H, $CH_3$

L=a single bond, $$\begin{array}{ll} \overset{O}{\overset{\|}{-C-}}, & \overset{O}{\overset{\|}{-S-}}, \end{array}$$

$$-SO_2-,\ -SO_3-,\ -O-,$$

$$\overset{|}{-N-},$$

Arylene, Alkylene,

<C=N—, —S—, nitrilo, and heterocyclyl containing one or more N, O, S; combination of these groups, and combinations of the above groups with alkylene chains;

M=—OR, —SR, —NHR, $-NR_1R_2$, —R, $$\overset{O}{\overset{\|}{-CR}},$$

wherein R, $R_1$, and $R_2$ represent:

(a) straight-chain or branched-chain alkyl substituents having 1 to 15 carbons, (b) arylene substituents, (c) heterocyclic substituents containing one or more N, S, O, (d) any of the groups described in (a) through (c) above having one or more sites of unsaturation, (e) any of the groups described (a) through (d) above in which hydrogen is substituted with one or more fluorine, chlorine, bromine, iodine, alkoxy, acyloxy, alkylsulfoxy, alkylsulfonyl, nitro, thio, keto, or nitrile groups, and (f) combinations of the groups described in (a) through (e) above;

wherein B in general Formula 1 represents recurring units of one or more hydrophilic ionic vinyl monomers of the general Formula 3, wherein X and L represent groups listed above under Formula 2, $$\begin{array}{l} \quad X \\ \quad | \\ H_2C= \\ \quad | \\ \quad L \\ \quad | \\ \quad Y \end{array} \quad (3)$$

and wherein:

Y=an ionic group including heterocyclic ionic groups such as imidazolium, thiazolium, pyridinium, as well as ionic groups such as $-NH_3^+$, $-NH_2R^+$, $-NHR_1R_2^+$, $-NR_1R_2R_3^+$, $=NR_1R_2^+$, $-CO_2^-$, $-SO_2^-$, $-SO_3^-$, $-O^-$, $-OPO_3^{-2}$ and $-SR_2^+$, wherein R, $R_1$, $R_2$, $R_3$=straight- or branched-chain alkyl of 1 to 10 carbons, and associated counterions of these ionic groups wherein D may represent either:

(a) one or more hydrophilic ionic monomers of Formula 3 having the same or opposite charge as B in Formula 1, or one or more hydrophilic nonionic vinyl monomers not represented by Formula 3, wherein the nonionic hydrophilic vinyl monomer may comprise up to 99.9 mole percent, as long as the ionic content represented by B is present in at least 0.1 mole percent, and ionic or nonionic hydrophilic vinyl monomer D can be selected from virtually any class of vinyl monomer capable of undergoing free radical polymerization; if D is ionic, then (y+z) of Formula 1 is less than or equal to about 30 mole percent;

(b) one or more hydrophobic nonionic vinyl monomers represented by general Formula 2 or one or more hydrophobic nonionic vinyl monomers not represented by Formula 2, to an extend generally less than 50 mole percent wherein D may be selected from any class of vinyl monomer, capable of undergoing free radical polymerization, derived from any other vinyl monomer used to make the polymer either by subsequent chemical modification of the polymer or by pH induced change in ionization to give an uncharged rather than ionic form; the hydrophobic monomer D may be one that is either insoluble in water, or forms homopolymers that are insoluble in water, or forms homopolymers that exhibit inverse temperature solubility properties (precipitate on heating in solution).

57. The article of claim 56 wherein B comprises at least one of vinyl ketones, N-vinyl amides, N-vinyl lactams, vinyl imidazoles, vinyl pyridines, vinyl sulfones, vinyl ethers, vinyl esters, vinyl urylenes, vinyl urethanes, vinyl nitriles, vinyl anhydrides, vinyl imines, vinyl imides, vinyl halides, vinyl aldehydes, styrenes and substituted styrenes, vinyl naphthalenes, vinyl heterocycles containing oxygen, nitrogen, or sulfur and combinations of these heteroatoms, acrylamides, methacrylamides, acrylates, and methacrylates.

58. The article of claim 56 wherein B comprises at least one monomer selected from the group consisting of sodium acrylate, 2-aminoethyl acrylate hydrochloride, 2-aminoethyl methacrylate hydrochloride, N-(3-amino-propyl)methacrylamide hydrochloride, p-styrenesulfonic acid sodium salt, N-(3-dimethylamino-propyl)methacrylamide hydrochloride, 2-aminoethyl vinyl ether hydrochloride, 2-aminoethyl styryl ether hydrochloride, 4-vinylpyridine hydrochloride, 2-vinylpyridine hydrochloride, N-vinylimidazole hydrochloride, N-alkyl-2-vinylimidazole hydrochlorides, N-alkyl-4-vinylimidazole hydrochloride, and N-(2-sulfo-1,1-dimethylethyl)acrylamide sodium salt.

59. The article of claim 56 wherein D comprises at least one of acrylamide, N-methylacrylamide, N,N-dimethylacrylamide, 2-hydroxyethyl acrylate, 2-hydroxyethyl methacrylate, 2-hydroxypropyl acrylate, 2-hydroxypropyl methacrylate, N-(2-hydroxyethyl)methacrylamide, N-(2-hydroxyethyl)acrylamide, and N-(2-hydroxypropyl)methacrylamide.

60. The article of claim 56 wherein A comprises at least one of butyl acrylate, butyl methacrylate, styrene and substituted styrenes, N-t-butylacrylamide, N-t-butylmethacrylamide, N-isopropylacrylamide, and N-isopropylmethacrylamide.

* * * * *

UNITED STATES PATENT AND TRADEMARK OFFICE

CERTIFICATE OF CORRECTION

PATENT NO. : 5,219,717

DATED : June 15, 1993

INVENTOR(S) : E. R. Schmittou et al

It is certified that error appears in the above-indentified patent and that said Letters Patent is hereby corrected as shown below:

Column 29,

At the end of claim 1, add --wherein said polymer is selectively more permeable to iodide in preference to thiosulfate and iodide is removed from said solution by contacting said solution with said composite article.--

In Column 32, line 7, delete "—c" and insert ---ċ--.

In Column 33, line 51, delete "-N-t-" and insert ---N-ṭ--.

Column 34,

At the end of claim 25, add --wherein said polymer is selectively more permeable to iodide in preference to thiosulfate.--

In Column 36, line 7, delete "—c" and insert ---ċ--.

In Column 37, line 32, delete "hydrochloride, p-" and insert --hydrochloride, ṗ--.

In Column 37, line 52, delete "N-t-" and insert --N-ṭ---.

UNITED STATES PATENT AND TRADEMARK OFFICE

CERTIFICATE OF CORRECTION

PATENT NO. : 5,219,717

DATED : June 15, 1993

INVENTOR(S) : E. R. Schmittou et al

It is certified that error appears in the above-indentified patent and that said Letters Patent is hereby corrected as shown below:

Column 37,

At the end of claim 46, add --wherein said polymer is selectively more permeable to iodide in preference to thiosulfate.--.

In Column 39, line 52, delete "<C" and insert --C̀--.

In Column 40, line 49, delete "extend" and insert --extent--.

In Column 41, line 9, delete "p-" and insert --p---.

In Column 42, line 1, delete "hydrochloride," and insert --hydrochlorides, N-alkyl-4-vinylimidazole hydrochlorides, N-alkyl-5-vinylimidazole hydrochlorides,--.

In Column 42, line 12, delete "N-t-" and insert --N-t---.

Signed and Sealed this

Twenty-second Day of March, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,219,717
DATED : June 15, 1993
INVENTOR(S) : Eric R. Schmittou, et. al.

It is certified that error appears in the above-indentified patent and that said Letters Patent is hereby corrected as shown below:

Column 34, at the end of claim 24, add --wherein said polymer is selectively more permeable to iodide in preference to thiosulfate--.

Column 37, at the end of claim 44, add --wherein said polymer is selectively more permeable to iodide in preference to thiosulfate--.

Signed and Sealed this

Twenty-eight Day of February, 1995

*Attest:*

Bruce Lehman

BRUCE LEHMAN

*Attesting Officer*

*Commissioner of Patents and Trademarks*